US008381323B2

(12) United States Patent
Mochita et al.

(10) Patent No.: US 8,381,323 B2
(45) Date of Patent: Feb. 26, 2013

(54) SANITARY WASHING APPARATUS

(75) Inventors: Masayuki Mochita, Fukuoka-ken (JP); Minoru Sato, Fukuoka-ken (JP); Masako Fujita, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 192 days.

(21) Appl. No.: 12/893,272

(22) Filed: Sep. 29, 2010

(65) Prior Publication Data

US 2011/0072571 A1 Mar. 31, 2011

(30) Foreign Application Priority Data

Sep. 30, 2009 (JP) ..... 2009-229000
Sep. 30, 2009 (JP) ..... 2009-229001
Sep. 30, 2009 (JP) ..... 2009-229002
Sep. 30, 2009 (JP) ..... 2009-229003

(51) Int. Cl.
*E03D 9/00* (2006.01)

(52) U.S. Cl. ..... 4/420.3

(58) Field of Classification Search ..... 4/443–448, 4/420.1–420.4

See application file for complete search history.

(56) References Cited

U.S. PATENT DOCUMENTS

| | | | | |
|---|---|---|---|---|
| 5,826,282 | A | 10/1998 | Matsumoto et al. | |
| 6,754,912 | B1 * | 6/2004 | Hayashi et al. | 4/420.2 |
| 7,191,473 | B2 * | 3/2007 | Matsumoto et al. | 4/420.2 |
| 8,161,580 | B2 * | 4/2012 | Hashidume et al. | 4/420.4 |

FOREIGN PATENT DOCUMENTS

| | | | |
|---|---|---|---|
| EP | 1424346 | A1 | 6/2004 |
| JP | 2001090151 | * | 3/2001 |
| JP | 2001-090151 | A | 4/2001 |
| JP | 2001-090154 | A | 4/2001 |
| JP | 2001-090155 | A | 4/2001 |
| JP | 2002-188202 | A | 7/2002 |
| JP | 2006-274603 | A | 10/2006 |
| JP | 3848886 | * | 11/2006 |
| JP | 3848886 | B2 | 11/2006 |
| JP | 2007-100370 | A | 4/2007 |
| WO | 2008/075063 | A1 | 6/2008 |

OTHER PUBLICATIONS

Japanese Office action for 2009-229003 dated Feb. 7, 2011.

* cited by examiner

*Primary Examiner* — Lori Baker
(74) *Attorney, Agent, or Firm* — Pearne & Gordon LLP

(57) ABSTRACT

A sanitary washing apparatus having a bidet washing function for jetting water at private parts of a female user, the apparatus includes: a nozzle including a jetting port configured to jet water; a swirling chamber and a communication channel for jetting water as a hollow-conic-shape liquid film flow at the private parts of the female user from the jetting port; and a fluid squiring device for generating an intermittent granular flow of granular water balls so as to fill inside the liquid film before the liquid film flow impinges on the private parts.

15 Claims, 13 Drawing Sheets

SANITARY WASHING APPARATUS

CROSS-REFERENCE TO RELATED APPLICATIONS

This application is based upon and claims the benefit of priority from the prior Japanese Patent Application No. 2009-229000, filed on Sep. 30, 2009, the prior Japanese Patent Application No. 2009-229001, filed on Sep. 30, 2009, the prior Japanese Patent Application No. 2009-229002, filed on Sep. 30, 2009 and the prior Japanese Patent Application No. 2009-229003, filed on Sep. 30, 2009; the entire contents of each are incorporated herein by reference.

BACKGROUND

1. Field of the Invention

Embodiments described herein relate generally to a sanitary washing apparatus having a bidet washing function for jetting water at the private parts of a female user.

2. Background Art

Sanitary washing apparatuses installed on warm water washing toilet seats are intended to squirt water at the private parts of a user from a nozzle to wash away dirt attached to the private parts and their vicinity. For men, the private parts to be washed are only the anus. For women, the private parts to be washed include the vaginal opening and urethral opening in addition to the anus.

The dirt attached to the anus and its vicinity is attached to the anus and its vicinity during defecation and washed within a relatively short time after attachment. The dirt in this case is washed in the state of being attached during defecation. Hence, the washing area is relatively narrow and limited to the close vicinity of the anus. Furthermore, even if water is squirted at the anus and its vicinity with a strong water force to some extent, the squirt with the strong water force is acceptable to users as long as it ensures sufficient washing power. Hence, typically, in washing the dirt attached to the anus and its vicinity, water with a relatively strong water force is squirted at a relatively narrow washing area.

On the other hand, in washing the woman's delicate area such as the vicinity of the vaginal opening and the vicinity of the urethral opening, the situation is different from that of washing only the vicinity of the anus. That is, it cannot be addressed by squirting water with a relatively strong water force at a relatively narrow washing area. This results from the diversity in the properties of the dirt attached to the woman's private parts and in the timing of the dirt being attached to the woman's private parts.

Specifically, excrements from the human body, such as urine, menstrual blood, and vaginal discharge ejected from the vaginal opening, are all liquid. On the other hand, there are significant differences in their properties, particularly in the viscosity, which significantly affects the performance of washing with water. For instance, urine and vaginal discharge during pregnancy have very low viscosity. On the other hand, typically, vaginal discharge around the ovulatory period has high viscosity. Furthermore, discharge of such excrements from the human body is not necessarily limited to during being seated on the toilet seat. Vaginal discharge and menstrual blood are ejected from the human body independently of time and place. These excrements are ejected from the vaginal opening, and then attached to the skin therearound. In particular, during menstruation, menstrual blood may be spread widely, oxidized by exposure to air, and clotted on the skin surface.

Thus, the type and state of the dirt to be removed by the sanitary washing apparatus are diverse. Hence, for the woman's delicate area, there is demand for expanding the washing area in view of the type and state of the attached dirt. Thus, as a technique for expanding the washing area, there is proposed a human body washing apparatus capable of jetting spirally swirled water from the jetting port of a nozzle (JP-A-2001-090155 and JP-A-2001-090151). By jetting spirally swirled water, the washing range can be adjusted in accordance with the degree of swirling. However, such jetting generates a hollow water flow having a film-like outer periphery. Thus, washing is insufficient in the hollow portion inside the hollow-conic shape.

On the other hand, there is proposed a sanitary washing apparatus capable of compensating for the insufficient washing of the hollow portion (JP-A-2007-100370). In this sanitary washing apparatus, a water flow is jetted also to the hollow portion inside the spirally swirling flow. Thus, while ensuring a wide washing area by the swirling flow, a water flow is added also to the hollow portion. However, in the sanitary washing apparatus described in JP-A-2007-100370, a continuous water flow is additionally jetted to the hollow portion inside the swirling flow. Hence, the washing pressure is high in the central portion of the washing area. This may apply unnecessarily strong stimuli to the woman's delicate area.

Furthermore, there is proposed a private parts washing apparatus capable of varying the washing area by varying the state of interference between the axial jet flow and the tangential jet flow (JP-A-2001-090154). In the private parts washing apparatus described in JP-A-2001-090154, a continuous water flow is jetted in the axial direction. Hence, the water pressure may become too high in the central portion of the washing area.

On the other hand, there is proposed a jetting apparatus capable of jetting water fragments in a swirling state (Japanese Patent No. 3848886). If such water fragments are jetted, the water fragments may drift in air and scatter to the outside of the desired washing area. Then, the drifted water may be attached to the thigh of the user seated on the toilet seat, and the user may feel discomfort.

SUMMARY

According to an aspect of the invention, there is provided a sanitary washing apparatus having a bidet washing function for jetting water at private parts of a female user, the apparatus including: a nozzle including a jetting port configured to jet water; jetting means for jetting water as a hollow-conic-shape liquid film flow at the private parts of the female user from the jetting port; and granular-flow generating means for generating an intermittent granular flow of granular water balls so as to fill inside the liquid film before the liquid film flow impinges on the private parts.

DETAILED DESCRIPTION

Figure 1:
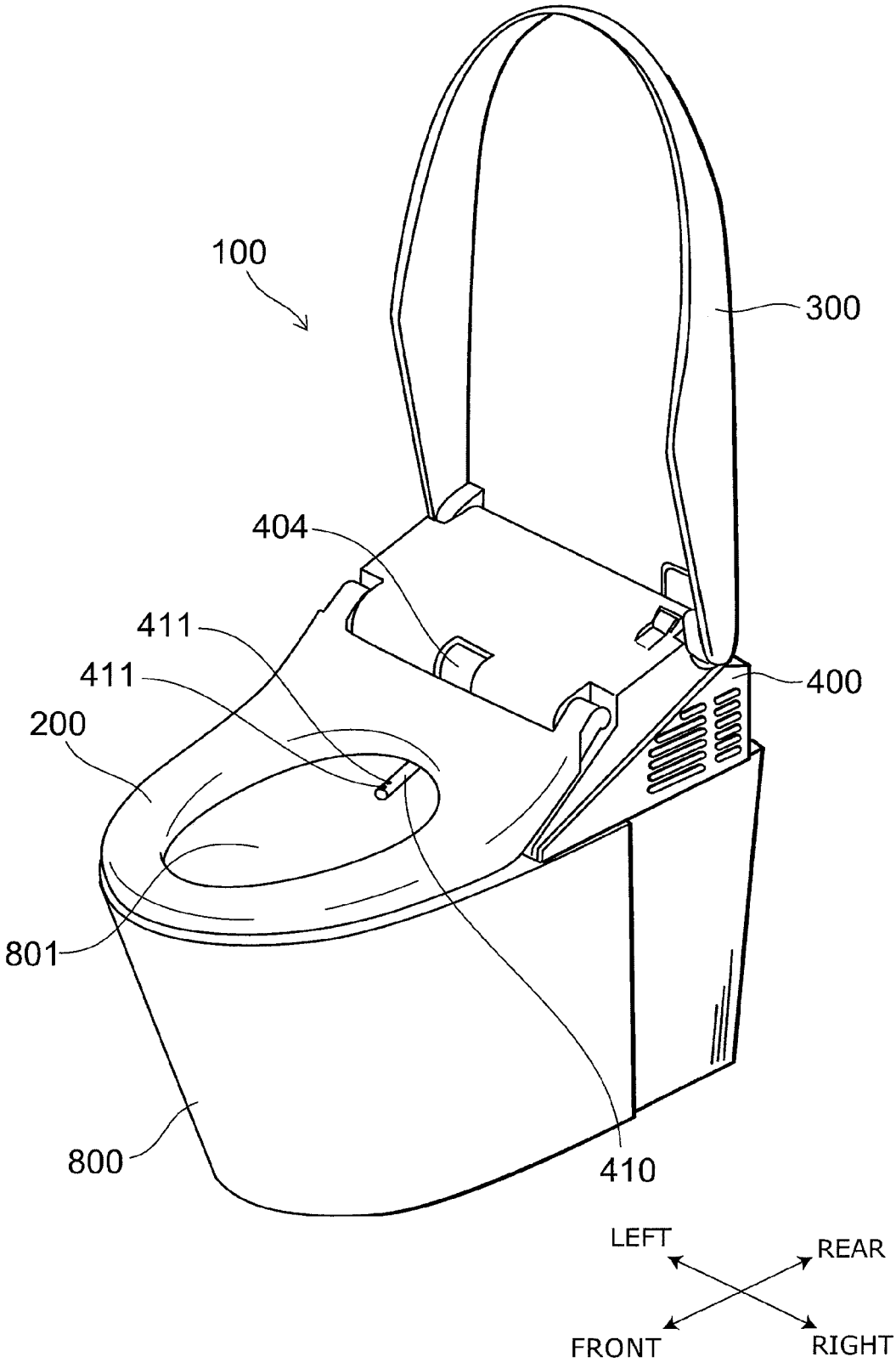
FIG. 1 is a perspective schematic view showing a toilet apparatus equipped with a sanitary washing apparatus according to an embodiment of the invention.

To solve the above problems, this invention provides a sanitary washing apparatus having a bidet washing function for jetting water at the private parts of a female user. The sanitary washing apparatus comprises a nozzle including a jetting port configured to jet water; jetting means for jetting water as a hollow-conic-shape liquid film flow at the private parts of the female user from the jetting port; and granular-flow generating means for generating an intermittent granular flow of granular water balls so as to fill inside the liquid film before the liquid film flow impinges on the private parts.

In this sanitary washing apparatus, the water squirted from the nozzle is jetted from the jetting port in a hollow-conic shape as a liquid film flow including a hollow portion at the center. Before impinging on the human private parts, the hollow portion of the liquid film flow is filled with an intermittent water flow of granular water balls (hereinafter referred to as "granular flow" for convenience of description), and impinges on a wider range of the human private parts of the user seated on the toilet seat.

The term "granular water ball" used herein refers to a water ball having a diameter as large as approximately 1 mm. It is distinguished from spray, which has a diameter of approximately 10-100 μm. Here, while the "granular water ball" primarily refers to a water ball having a diameter of approximately 1 mm, the "granular water ball" also partly includes a water drop having a smaller particle diameter, such as approximately larger than 100 μm and less than 1 mm.

For instance, during women's menstruation, menstrual blood dirt may be attached to a wide range around the woman's private parts. The sanitary washing apparatus of this invention can wash at once the dirt attached to a wide range of skin. More specifically, the inside of the liquid film flow jetted in a hollow-conic shape is filled with a granular flow of granular water balls. This can suppress the occurrence of a hollow portion at the time of impingement and ensure sufficient washing performance also in the central portion of the washing area.

Here, the washing area (impinging area) of water is e.g. approximately 35-45 mm in diameter. The liquid film flow may impinge on the human private parts in the state of granular water balls fragmented from the liquid film flow, or may impinge on the human private parts while remaining the liquid film flow.

An intermittent granular flow of granular water balls impinges on the vicinity of the center of the washing area. Thus, while maintaining the washing performance in the central portion of the washing area, the washing pressure in the central portion of the washing area can be made lower than in the case of impingement of the conventional continuous water flow. This can reduce the danger that unnecessarily strong stimuli are applied to the delicate area located around the center of the woman's private parts. Furthermore, without causing a female user to feel discomfort, the vicinity of the center of the washing area can be sufficiently washed.

Furthermore, the sanitary washing apparatus of this invention enables water to impinge at once on a wider range than in the conventional bidet washing. Hence, there is no need to move the impingement position by moving the nozzle in the front-rear direction and left-right direction. This can reduce the danger of giving a feeling of being swept by the movement of the impingement position. Furthermore, there is also no need for the user seated on the toilet seat to move the seated position by oneself to move the impingement position. Thus, the sanitary washing apparatus can be used comfortably.

Furthermore, the sanitary washing apparatus of this invention forms the outline of the washing area from the liquid film flow. That is, this liquid film flow serves as a kind of wall and prevents water drops having a smaller diameter than the water ball partly included in the granular flow from scattering to the outside of the washing area. This can suppress impingement of water outside the washing area, and can suppress unnecessary wetting of the portion (e.g., thigh) outside the desired washing area.

In an aspect of the sanitary washing apparatus according to this invention, the jetting means includes a swirling chamber capable of generating a swirling flow; and a communication channel configured to guide the swirling flow to the jetting port. The jetting means is configured so that the hollow-conic-shape liquid film flow is formed from the swirling flow and jetted from the jetting port.

In the above configuration, the liquid film flow is formed from the swirling flow. Hence, despite a simple configuration, the liquid film flow can be stably formed.

In an aspect of the sanitary washing apparatus according to this invention, the granular-flow generating means is configured to generate the intermittent granular flow of granular water balls by fragmenting the liquid film flow.

In the sanitary washing apparatus of this invention, water is jetted as a hollow-conic-shape liquid film flow from the nozzle. The water is fragmented by the granular-flow generating means at a position spaced to some extent from the nozzle before impinging on the private parts. The inside of the liquid film flow is filled with an intermittent granular flow of water balls. Thus, air is likely to enter the hollow portion of the hollow-conic-shape liquid film flow from outside the liquid film flow.

The pressure in the hollow portion of the liquid film flow is lower than the pressure outside the liquid film flow. The reason for this is as follows. Air is less likely to enter the hollow portion of the liquid film flow from outside. Furthermore, the air in the hollow portion is drawn out by the stream of the liquid film flow. Hence, the hollow portion of the liquid film flow is in a negative pressure state in which the pressure is lower than that of the ambient air.

Here, if the jet diameter (cone diameter) of the liquid film flow continues to expand without fragmentation of the liquid film flow, the thickness of the liquid film is thinned with the expansion of the jet diameter. The site where the thickness of the liquid film is thinned is more susceptible to the pressure difference between the inside portion of the liquid film flow and the outside portion of the liquid film flow than the site where the thickness of the liquid film was thick before expansion of the jet diameter. Thus, before impinging on the private parts, at a position spaced to some extent from the jetting port of the nozzle, a phenomenon occurs in which the liquid film flow ripples due to the pressure difference between the inside portion and the outside portion of the liquid film flow while retaining the state of the liquid film flow. In this specification, such a phenomenon is referred to as "liquid film rippling".

Liquid film rippling occurs due to the pressure difference between the inside and outside of the liquid film at a position where the thickness of the liquid film is thinned. Furthermore, the occurrence of rippling further elongates the trajectory of the liquid film. Hence, the thickness of the liquid film becomes thinner. If liquid film rippling occurs, the liquid film flow is fragmented into a spray flow. The spray flow drifts in air, and is likely to scatter to the outside of the desired washing area.

In contrast, in the sanitary washing apparatus of this invention, the liquid film flow is fragmented by the granular-flow generating means before liquid film rippling occurs in the liquid film flow. This can suppress generation of a spray flow due to the effect of liquid film rippling, and reliably generate an intermittent granular flow of granular water balls. Furthermore, scattering of water in irregular directions to the outside of the desired washing area can be suppressed. Unnecessary wetting of the portion outside the desired washing area can be suppressed.

In an aspect, the granular-flow generating means is configured to fragment the liquid film flow by generating a water flow in a direction traversing the liquid film flow to cause a crack in the traversing direction of the liquid film flow.

In the sanitary washing apparatus of this invention, the water jetted from the nozzle forms a liquid film flow. The liquid film flow is fragmented by the granular-flow generating means at a position spaced to some extent from the nozzle, and transitions to an intermittent granular flow. Here, the granular-flow generating means fragments the liquid film by generating a water flow in a direction traversing the liquid film of the liquid film flow to cause a crack in the traversing direction of the liquid film flow. Because the liquid film is subjected to shear fragmentation, the liquid film can be fragmented into water balls as large as the thickness of the liquid film. This can suppress generation of a spray flow, and suppress scattering of water to the outside of the desired washing area. Furthermore, because large water balls can be formed, a sufficient impinging water pressure can be obtained, and a comfortable feeling of washing can be obtained.

In an aspect, the granular-flow generating means is configured to cause a crack in the traversing direction of the liquid film flow by producing a velocity difference between the velocity outside the liquid film flow and the velocity inside the liquid film flow.

In this sanitary washing apparatus, the granular-flow generating means produces a velocity difference between the velocity of water outside the liquid film and the velocity of water inside the liquid film to generate a water flow in a direction traversing the liquid film. Hence, as compared with the convection resulting from the water temperature difference, water flows in the direction traversing the liquid film occur at positions closer to each other. Thus, the liquid film flow can be fragmented more reliably at a position spaced to some extent from the nozzle.

In an aspect, the granular-flow generating means is configured to produce a velocity difference between velocities outside and inside the liquid film flow by making the velocity outside the liquid film flow slower than the velocity inside the liquid film flow.

The pressure inside the liquid film flow is lower than the pressure outside the liquid film flow. However, if the inside pressure is too low, the liquid film flow is granulated before the jet diameter (cone diameter) sufficiently expands. Thus, there is danger of failing to ensure the desired washing area.

In contrast, in the sanitary washing apparatus of this invention, the granular-flow generating means is configured to produce a velocity difference between velocities outside and inside the liquid film flow by making the velocity outside the liquid film flow slower than the velocity inside the liquid film flow. Hence, outer surface convection from inside to outside occurs. Because this convection occurs at the outer surface, it is less susceptible to the negative pressure inside the liquid film flow. Thus, water can be reliably caused to impinge on a wide washing area by sufficiently expanding the cone diameter.

In an aspect, the jetting means includes a squirting port configured to jet the water on the upstream side of the jetting port of the nozzle so that the liquid film flow is jetted from the jetting port by jetting the hollow-conic-shape liquid film flow from the squirting port toward the jetting port of the nozzle. The granular-flow generating means includes an annular flow channel provided on the downstream side of the jetting means and having a larger diameter than the squirting port. The granular-flow generating means is configured so that a downstream end portion of the annular flow channel constitutes the jetting port of the nozzle.

In this sanitary washing apparatus, the liquid film flow jetted in a hollow-conic shape is decelerated by the frictional force generated at the inner wall of the annular flow channel. Hence, the thickness of the liquid film flow can be thickened by a simpler configuration. Thus, the occurrence of liquid film rippling in the liquid film flow jetted from the nozzle can be reliably prevented.

In an aspect, the annular flow channel is configured to have a throat shape including a taper portion having a flow channel diameter expanding toward the downstream side, and a linear portion provided on the upstream side of the taper portion and having a constant flow channel diameter.

In this sanitary washing apparatus, the annular flow channel has a throat shape including a taper portion having a flow channel diameter expanding toward the downstream side of the flow channel, and an linear portion provided on the upstream side of the taper portion and having a constant flow channel diameter. Hence, the liquid film flow can be decelerated more reliably when the liquid film flow passes through the taper portion. Thus, the thickness of the liquid film flow can be thickened more reliably.

In an aspect of the sanitary washing apparatus, the jetting means includes a swirling chamber capable of generating a swirling flow and a communication channel configured to guide the swirling flow to the squirting port. The jetting means is configured so that the hollow-conic-shape liquid film flow is formed from the swirling flow and jetted from the squirting port. The granular-flow generating means includes a spiral groove on an inner wall surface of the annular flow channel.

In this sanitary washing apparatus, the liquid film flow is formed from the swirling flow. Hence, the liquid film flow includes a flow in the rectilinear direction and a flow in the swirling direction. On the other hand, in the granular-flow generating means, a spiral groove is formed on the inner wall surface of the annular flow channel. Hence, the flow in the swirling direction is maintained without deceleration, making it possible to significantly decelerate only the flow in the rectilinear direction. Furthermore, by providing a spiral groove, the time of contact between the liquid film flow and the inner wall of the annular flow channel can be prolonged. Thus, a granular flow including larger water balls can be reliably generated.

In an aspect, the granular-flow generating means is configured to fragment the liquid film flow by pulsating the liquid film flow.

In this sanitary washing apparatus, the granular-flow generating means fragments the liquid film flow by providing pulsation to the hollow-conic-shape liquid film flow. This can increase the diameter of the water ball included in the granular flow, and increase the impinging water pressure and impinging water amount at the impingement site. Thus, for instance, menstrual blood dirt during women's menstruation can be removed or released more rapidly and washed away.

In an aspect, the granular-flow generating means includes a water-pressure modulator configured to pulsate the liquid film flow.

In this sanitary washing apparatus, a water-pressure modulator is used. Thus, the liquid film flow can be reliably pulsated and thereby fragmented using a simple configuration.

In an aspect, the granular-flow generating means is configured to squirt fluid at the liquid film flow so as to fragment the liquid film flow by generating a water flow in a direction traversing the liquid film flow.

In this sanitary washing apparatus, the granular-flow generating means squirts fluid at the liquid film flow so as to fragment the liquid film flow. Hence, the position where the liquid film flow is fragmented can be controlled more accurately. This can prevent more reliably the situation in which, for instance, before the liquid film flow is fragmented, the thickness of the liquid film is excessively thinned to cause liquid film rippling.

In an aspect, the granular-flow generating means is configured to jet second jetting water to generate the granular flow. The second jetting water is different from first jetting water for forming the liquid film flow from the jetting means.

In this sanitary washing apparatus, the granular flow is generated by the second jetting water different from the first jetting water for forming the liquid film flow. Hence, the impinging water pressure and impinging water amount in the washing area can be more easily controlled to be uniform. Accordingly, the impinging amount and impinging water pressure in the outer peripheral portion of the washing area can be sufficiently ensured. Thus, sufficient washing performance can be ensured in the outer peripheral portion of the washing area.

In an aspect, the nozzle is configured so that an outer peripheral portion formed from the hollow-conic-shape liquid film flow by the jetting means and the granular flow filling inside of the hollow-conic shape by the granular-flow generating means impinge on the private parts. The nozzle is further configured so that when the water impinges on the private parts, impinging water pressure of the water per unit area is higher in the outer peripheral portion than in the inside.

Menstrual blood widely spread during menstruation may be oxidized by exposure to air, and clotted on the skin surface particularly in the outer peripheral portion. Thus, the outer peripheral portion of the desired washing area is an area desired to be actively washed, because the menstrual blood dirt may be attached thereto in a clotted state. In this sanitary washing apparatus, impinging water pressure in the outer peripheral portion is higher than impinging water pressure in the inside. Hence, water having higher washing performance can be caused to impinge on the outer peripheral portion. Thus, even the menstrual blood clotted in the outer peripheral portion can be sufficiently washed.

In an aspect, the nozzle is configured so that an outer peripheral portion formed from the hollow-conic-shape liquid film flow by the jetting means and the granular flow filling inside of the hollow-conic shape by the granular-flow generating means impinge on the private parts. The nozzle is further configured so that when the water impinges on the private parts, impinging amount of the water per unit area is larger in the outer peripheral portion than in the inside.

In this sanitary washing apparatus, the amount of water impinging on the outer peripheral portion is larger than the amount of water impinging on the inside. Hence, water having higher washing performance can be caused to impinge on the outer peripheral portion. Thus, even the menstrual blood clotted in the outer peripheral portion can be sufficiently washed.

Embodiments of the invention will now be described with reference to the drawings. In the drawings, similar components are labeled with like reference numerals, and the detailed description thereof is omitted as appropriate.

FIG. 1 is a perspective schematic view showing a toilet apparatus equipped with a sanitary washing apparatus according to an embodiment of the invention.

The toilet apparatus shown in FIG. 1 includes a sit-down toilet stool (hereinafter simply referred to as "toilet stool" for convenience of description) 800 and a sanitary washing apparatus 100 provided thereon. The sanitary washing apparatus 100 includes a casing 400, a toilet seat 200, and a toilet lid 300. The toilet seat 200 and the toilet lid 300 are each pivotally supported on the casing 400 in an openable/closable manner.

The casing 400 includes therein e.g. a private parts washing functional part for washing the human private parts of a user seated on the toilet seat 200. Furthermore, for instance, the casing 400 includes a seating sensor 404 for sensing seating of a user on the toilet seat 200. When the seating sensor 404 is sensing a user seated on the toilet seat 200, the user can manipulate a manipulator such as a remote control, not shown, to advance a nozzle 410 into the bowl 801 of the toilet stool 800. In the sanitary washing apparatus 100 shown in FIG. 1, the nozzle 410 is shown in the state of being advanced into the bowl 801.

One or more jetting ports 411 are provided at the tip of the nozzle 410. The nozzle 410 can squirt water from the jetting port 410 provided at its tip to wash the human private parts of the user seated on the toilet seat 200. For instance, of the two jetting ports 411 in the nozzle 410 shown in FIG. 1, one jetting port 411 is intended for bidet washing, and the other jetting port 411 is intended for bottom washing. Here, the term "water" used herein refers not only to cold water, but also to heated hot water.

Figure 2:
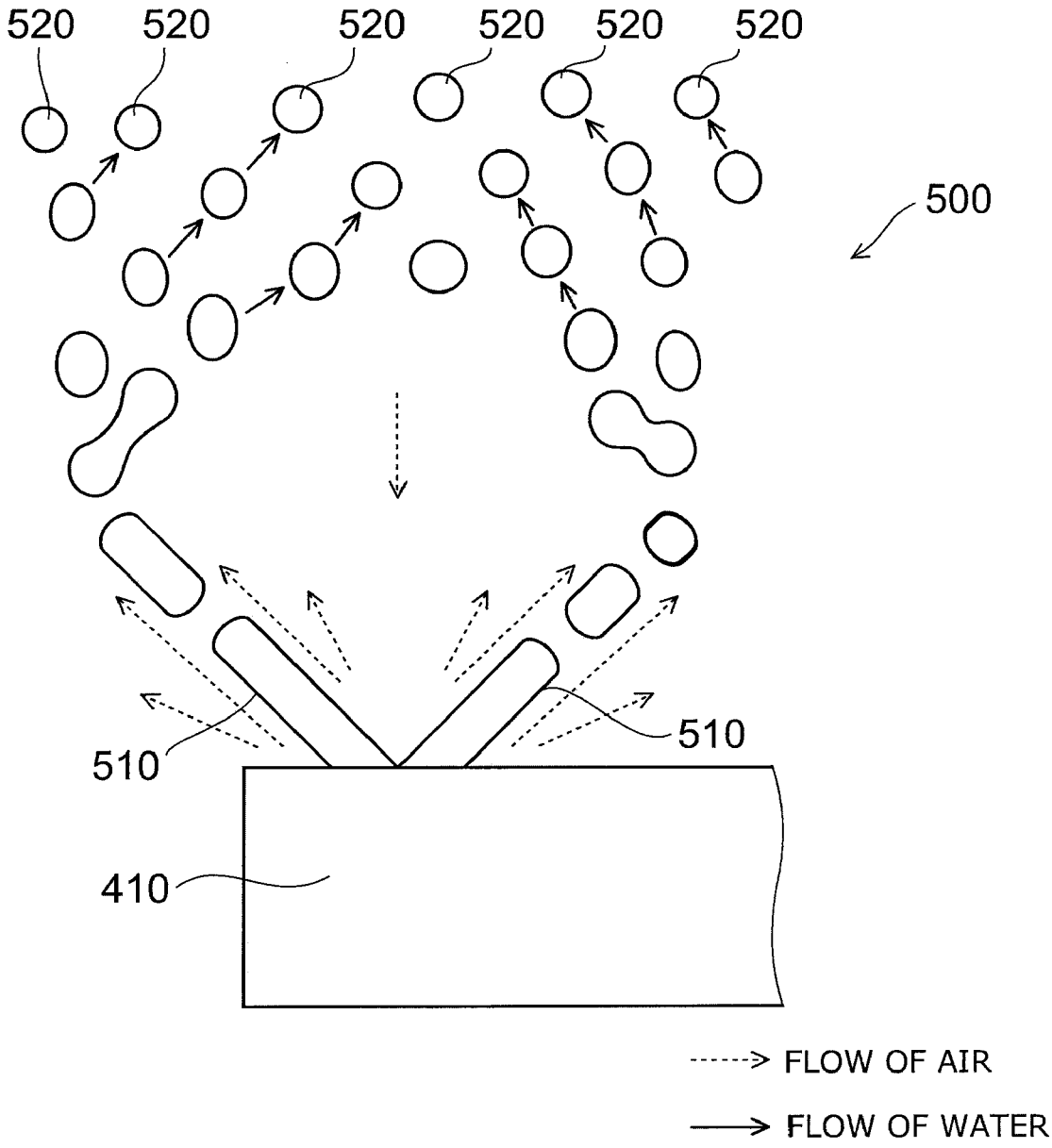
FIG. 2 is a conceptual schematic view generally showing the state of water jetted from the nozzle of this embodiment.

FIG. 2 is a conceptual schematic view generally showing the state of water jetted from the nozzle of this embodiment.

Figure 3:
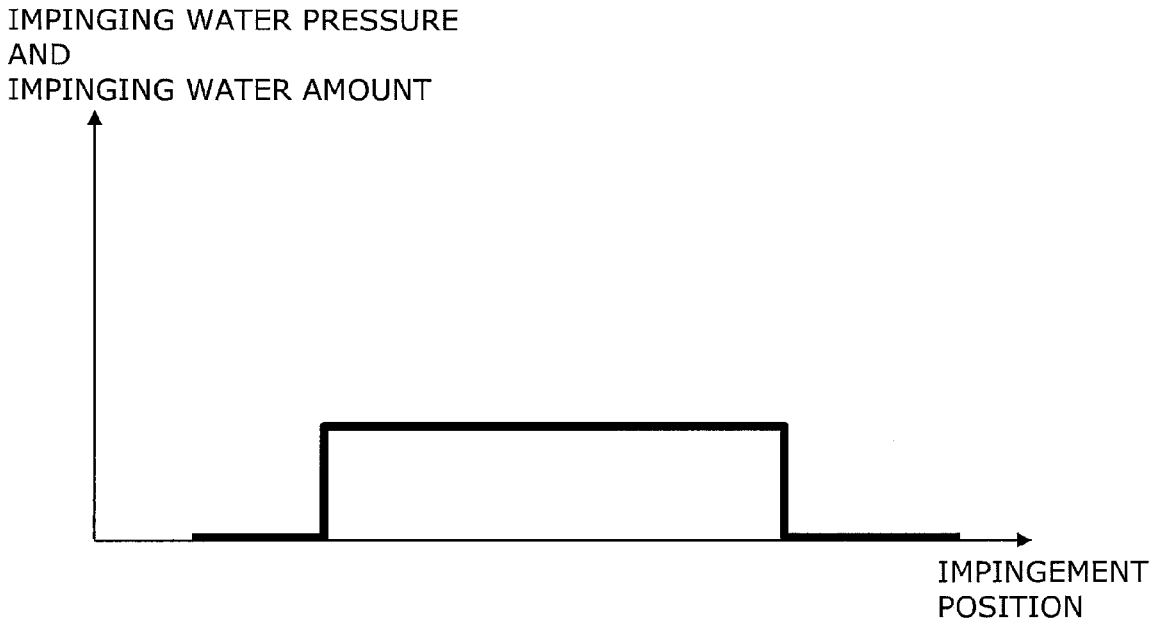
FIG. 3 is a graph showing an example of impinging water pressure and impinging water amount at the impingement site of water.

FIG. 3 is a graph showing an example of impinging water pressure and impinging water amount at the impingement site of water.

Figure 4:
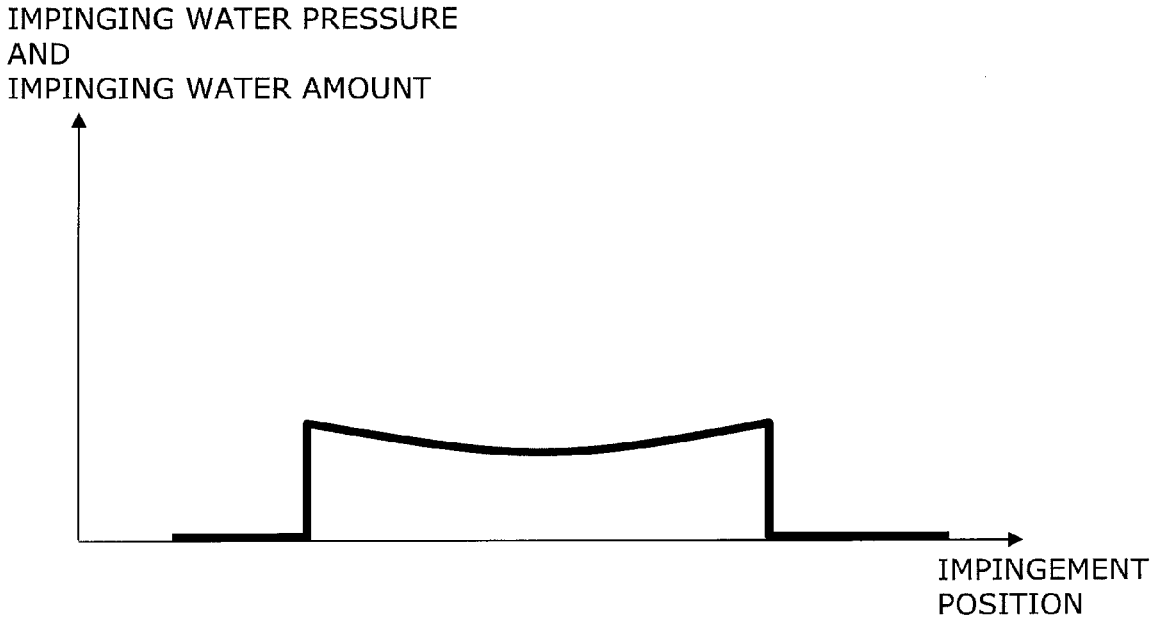
FIG. 4 is a graph showing another example of impinging water pressure and impinging water amount at the impingement site of water.

FIG. 4 is a graph showing another example of impinging water pressure and impinging water amount at the impingement site of water.

As described above with reference to FIG. 1, the nozzle 410 of this embodiment can squirt water 500 from the jetting port 411 at the human private parts of the user seated on the toilet seat 200. Here, as shown in FIG. 2, the water 500 is jetted from the jetting port 411 as a hollow-conic-shape liquid film flow including a hollow portion at the center. That is, the sanitary washing apparatus 100 according to this embodiment includes jetting means for jetting water as a hollow-conic-shape liquid film flow from the jetting port 411 of the nozzle 410.

The sanitary washing apparatus 100 according to this embodiment further includes granular-flow generating means for generating an intermittent granular flow of granular water balls so as to fill the hollow portion of the liquid film flow 510 before the liquid film flow 510 impinges on the human private parts. As shown in FIG. 2, the granular-flow generating means generates an intermittent granular flow of granular water balls. The details of the granular-flow generating means are described later.

Part of the granular flow 520 traveling in the traveling direction of the liquid film is attracted to the hollow portion by the negative pressure generated in the hollow portion of the liquid film flow 510. The reason for this is as follows. Air is less likely to enter the hollow portion of the liquid film flow 510 from outside. Furthermore, the air in the hollow portion is drawn out by the stream of the liquid film flow 510. Hence, the pressure in the hollow portion of the liquid film flow 510 becomes lower than the pressure outside the liquid film flow 510. Thus, the granular-flow generating means can fill the hollow portion of the liquid film flow 510 with the granular flow 520. Here, the granular water ball constituting the granular flow 520 has a diameter of e.g. approximately 1 mm (millimeter). That is, the granular water ball has a larger diameter than spray, which has a diameter of e.g. approximately 10-100 μm (microns). Here, while the granular flow is primarily composed of granular water balls, the granular flow may include a slight amount of water drops having a smaller diameter, such as larger than 100 μm and less than approximately 1 mm.

That is, the water 500 squirted from the nozzle 410 is first jetted as a liquid film flow 510 from the jetting port 411. Then, with the hollow portion filled with an intermittent granular flow 520, the water 500 impinges on a wider range of the human private parts of the user seated on the toilet seat 200. Here, the liquid film flow 510 may impinge on the human private parts in the state in which the liquid film is fragmented and granulated. Alternatively, the liquid film flow 510 may impinge on the human private parts while remaining in the state of the liquid film.

When the liquid film flow 510 impinges on the human private parts, as shown in FIG. 3, the impinging water pressure and the impinging water amount at the impingement site of the water 500 are generally equal in the central portion and in the outer peripheral portion of the impingement site. Alternatively, as shown in FIG. 4, the impinging water pressure and the impinging water amount are larger in the outer peripheral portion than in the central portion of the impingement site.

Here, the term "impinging water pressure" used herein refers to the momentum per unit area, representing the power of removing, stripping, or releasing dirt.

The term "impinging water amount" used herein refers to the amount of water impinging per unit time, representing the power of washing dirt away.

Next, examples of the jetting mode of water jetted from the nozzle of this embodiment are generally described with reference to the drawings.

Figure 5:
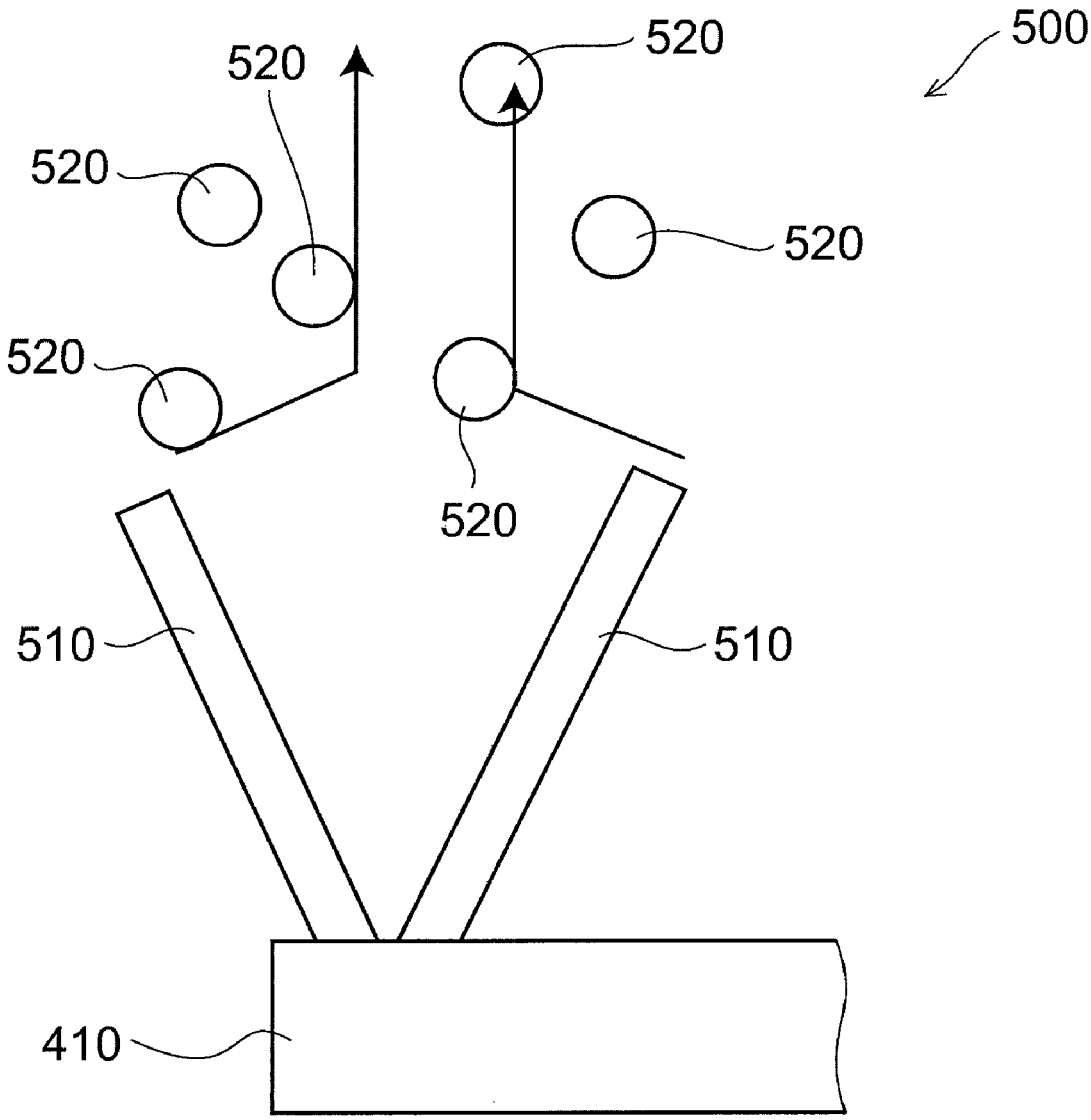
FIG. 5 is a conceptual schematic view illustrating a jetting mode of water jetted from the nozzle of this embodiment.

FIG. 5 is a conceptual schematic view illustrating a jetting mode of water jetted from the nozzle of this embodiment.

Figure 6:
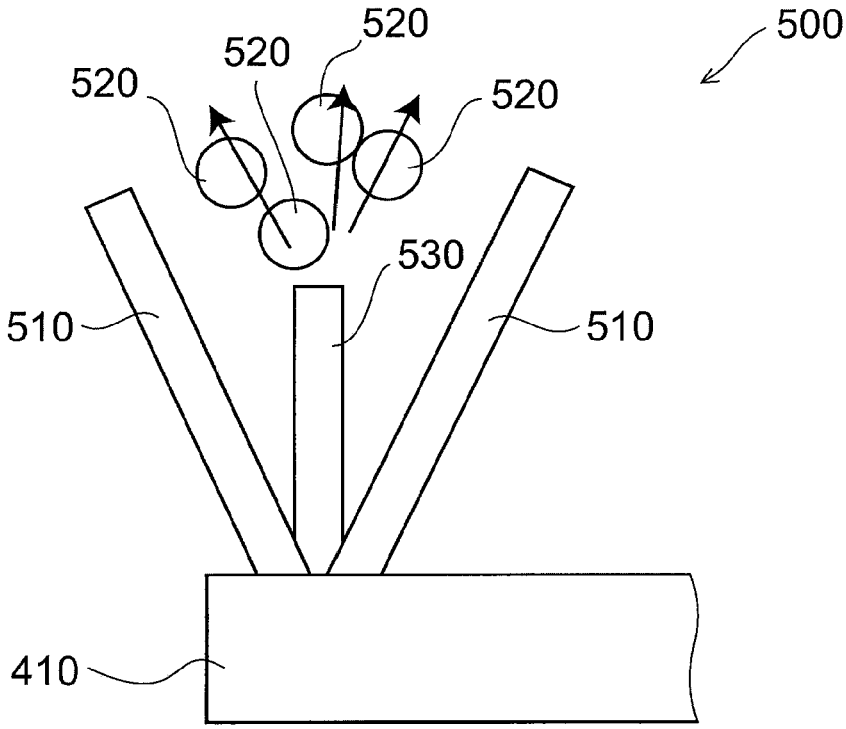
FIG. 6 is a conceptual schematic view illustrating another jetting mode of water jetted from the nozzle of this embodiment.

FIG. 6 is a conceptual schematic view illustrating another jetting mode of water jetted from the nozzle of this embodiment.

Figure 7:
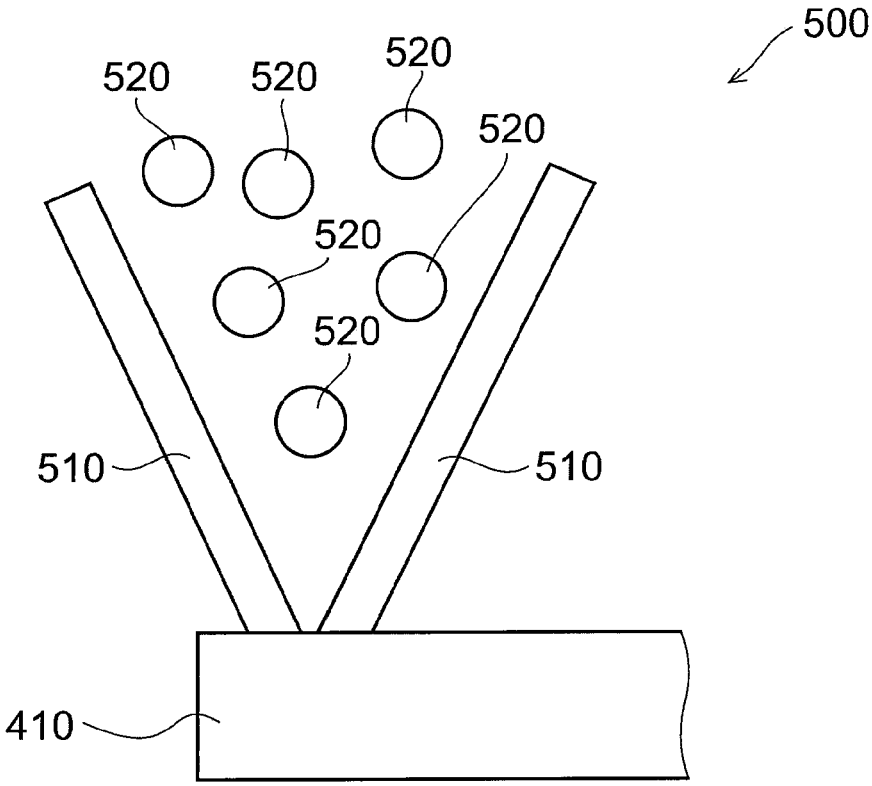
FIG. 7 is a conceptual schematic view illustrating still another jetting mode of water jetted from the nozzle of this embodiment.

FIG. 7 is a conceptual schematic view illustrating still another jetting mode of water jetted from the nozzle of this embodiment.

In the jetting mode shown in FIG. 5, the liquid film flow 510 is fragmented before impinging on the human private parts, and transitions to an intermittent granular flow 520. Then, the granular flow 520 impinges on a wider range of the human private parts. More specifically, in the water 500 squirted from the nozzle 410, the liquid film flow 510 itself is fragmented and transitions to an intermittent granular flow 520. The hollow portion of the water 500 is filled with the intermittent granular flow 520. Then, the water 500 impinges on the human private parts. In the jetting mode shown in FIG. 5, the impinging water pressure and the impinging water amount at the impingement site are as shown in FIG. 3. The method for fragmenting the liquid film flow 510 to generate a granular flow 520 is described later in detail.

In the jetting mode shown in FIG. 6, second jetting water 530 different from the first jetting water for forming the liquid film flow 510 is jetted to the central portion, or hollow portion, of the liquid film flow 510. The second jetting water 530 is fragmented before impinging on the human private parts, and transitions to a granular flow 520, which is an intermittent water flow. More specifically, in the water 500 squirted from the nozzle 410, the second jetting water 530 is fragmented and transitions to a granular flow 520. The hollow portion of the liquid film flow 510 is filled with the granular flow 520. Then, the water 500 impinges on the human private parts.

Here, the second jetting water 530 jetted to the hollow portion of the liquid film flow 510 may be configured as either a rectilinear flow or a swirling flow.

On the other hand, the liquid film flow 510 may impinge on the human private parts in the state in which the liquid film is fragmented and granulated. Alternatively, the liquid film flow 510 may impinge on the human private parts while remaining in the state of the liquid film. The method for jetting the second jetting water 530 and the method for fragmenting the second jetting water 530 are described later in detail.

In the jetting mode shown in FIG. 7, an intermittent granular flow 520 is jetted to the central portion, or hollow portion, of the liquid film flow 510. More specifically, in the jetting mode shown in FIG. 5, the liquid film flow 510 itself transitions to a granular flow 520. In the jetting mode shown in FIG. 6, the second jetting water 530 transitions to a granular flow 520. In the jetting mode shown in FIG. 7, a granular flow 520 is jetted from the nozzle 410 in the hollow portion of the liquid film flow 510. Thus, in the water 500 squirted from the nozzle 410, the hollow portion of the liquid film flow 510 is filled with the granular flow 520 jetted from the nozzle 410. Then, the water 500 impinges on the human private parts.

On the other hand, as in the jetting mode described above with reference to FIG. 6, the liquid film flow 510 may impinge on the human private parts in the state in which the liquid film is fragmented and granulated. Alternatively, the liquid film flow 510 may impinge on the human private parts while remaining in the state of the liquid film. The method for jetting the granular flow 520 from the nozzle 410 is described later in detail.

As described above, according to this embodiment, the water 500 squirted from the nozzle 410 is first jetted as a liquid film flow 510 from the jetting port 411. Then, with the hollow portion filled with an intermittent granular flow 520, the water 500 impinges on a wider range of the human private parts of the user seated on the toilet seat 200. Here, the washing area (impinging area) of water 500 is e.g. approximately 35-45 mm in diameter. That is, the width of the raised portion shown in FIGS. 3 and 4 is equivalent to e.g. approximately 35-45 mm.

For instance, during women's menstruation, menstrual blood dirt may be attached to a wide range around the woman's private parts. The sanitary washing apparatus 100 according to this embodiment can wash the wide range quickly at once.

Furthermore, an intermittent granular flow 520 with the filled hollow portion of the liquid film flow 510 impinges on the vicinity of the center of the washing area. Hence, the washing pressure in the central portion of the washing area is lower than in the case of impingement of the conventional continuous rectilinear flow. Hence, there is little danger that unnecessarily strong stimuli are applied to the woman's delicate area located around the center of the woman's private parts. Thus, the sanitary washing apparatus 100 according to this embodiment can realize bidet washing with a very comfortable feeling of washing.

Furthermore, the sanitary washing apparatus 100 according to this embodiment enables water to impinge at once on a wider range than in the conventional bidet washing. Hence, there is no need to move the impingement position by moving the nozzle 410 in the front-rear direction and left-right direction (see the arrows shown in FIG. 1). Furthermore, there is also no need for the user seated on the toilet seat 200 to move the seated position by oneself to move the impingement position. Hence, in the sanitary washing apparatus 100 according to this embodiment, there is little danger of giving a feeling of being swept in washing a wide range of the human private parts. Also in this respect, the sanitary washing apparatus 100 according to this embodiment can realize bidet washing with a very comfortable feeling of washing.

Furthermore, the sanitary washing apparatus 100 according to this embodiment forms the outline of the washing range from the liquid film flow 510. This liquid film flow 510 acts as a kind of wall. This can prevent water drops having a smaller diameter than the granular water ball included in the granular flow from scattering to the outside of the washing area. This can suppress unnecessary wetting of the portion (e.g., thigh) outside the desired washing area, and can suppress discomfort felt by the user seated on the toilet seat 200.

Furthermore, according to this embodiment, as shown in FIG. 3, the impinging water pressure at the impingement site of the water 500 is generally equal in the central portion and in the outer peripheral portion of the impingement site. Alternatively, as shown in FIG. 4, the impinging water pressure at the impingement site of the water 500 is higher in the outer peripheral portion than in the central portion of the impingement site. Here, the outer peripheral portion of the desired washing area is an area desired to be actively washed when menstrual blood dirt during women's menstruation is attached thereto. In this embodiment, impinging water pressure in the outer peripheral portion is generally equal to or higher than impinging water pressure in the central portion. Thus, the water 500 with high washing power impinges on the area where menstrual blood dirt is to be removed. On the other hand, the water with low impinging water pressure impinges on the woman's delicate area. Hence, unnecessarily strong stimuli are not applied thereto. Thus, the sanitary washing apparatus 100 according to this embodiment can remove or release menstrual blood dirt more rapidly. Furthermore, bidet washing with a very comfortable feeling of washing can be realized.

Furthermore, according to this embodiment, as shown in FIG. 3, the impinging water amount at the impingement site of the water 500 is generally equal in the central portion and in the outer peripheral portion of the impingement site. Alternatively, as shown in FIG. 4, the impinging water amount at the impingement site of the water 500 is larger in the outer peripheral portion than in the central portion of the impingement site. Here, as described above, impinging water amount in the outer peripheral portion, where menstrual blood dirt during women's menstruation is likely to be attached, is generally equal to or larger than impinging water amount in the central portion. Thus, a sufficient amount of water 500 can be caused to impinge on the area where menstrual blood dirt is to be removed. On the other hand, the water with a smaller impinging water amount impinges on the woman's delicate area. This can suppress discomfort due to washing with an unnecessarily large amount of water. Thus, menstrual blood dirt is captured more reliably by the impinging water 500, and washed away more rapidly. Furthermore, bidet washing with a very comfortable feeling of washing can be realized.

Next, an example of this embodiment is described with reference to the drawings.

Figure 8:
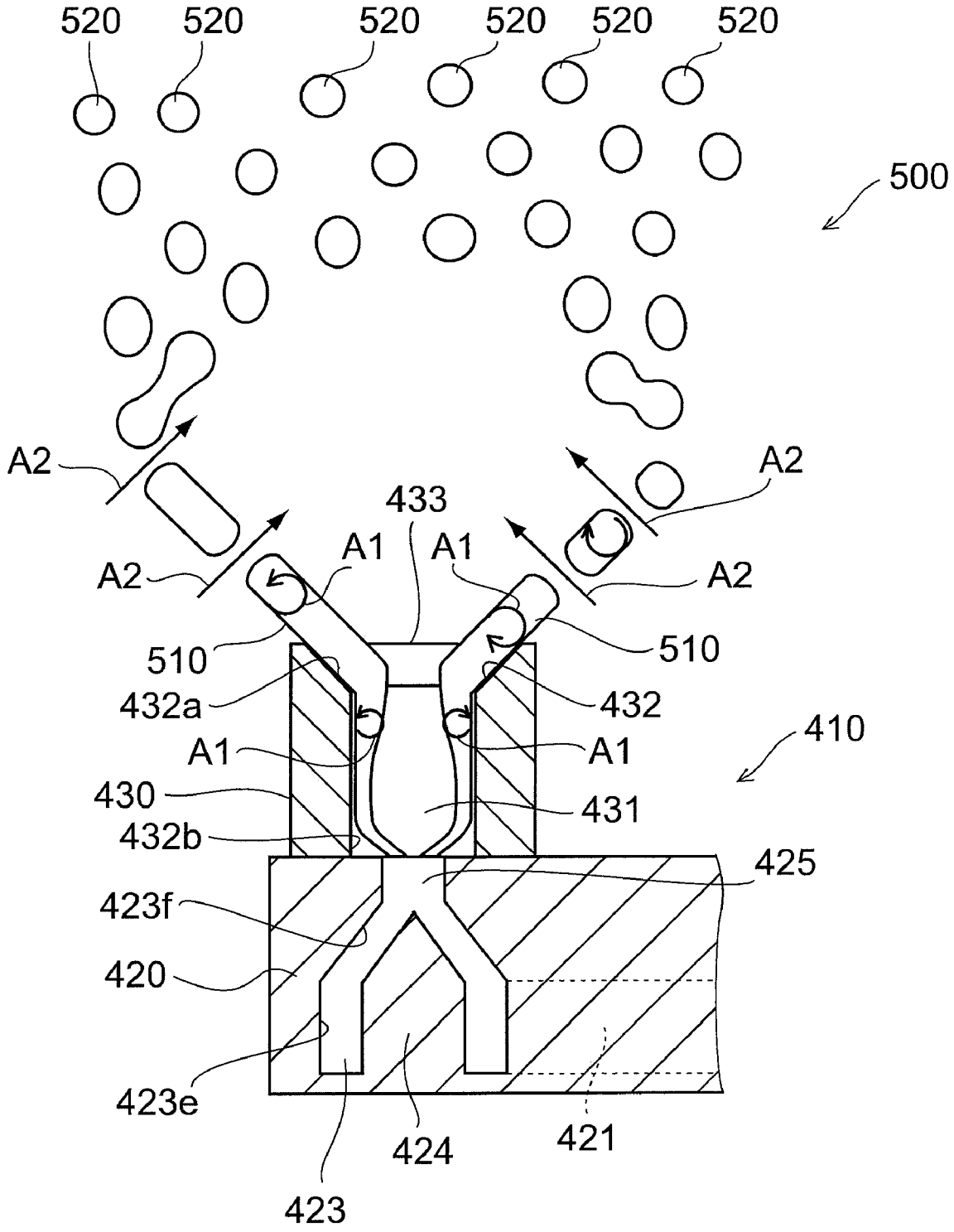
FIG. 8 is a sectional schematic view showing a nozzle according to an example of this embodiment.

FIG. 8 is a sectional schematic view showing a nozzle according to an example of this embodiment.

Figure 9:
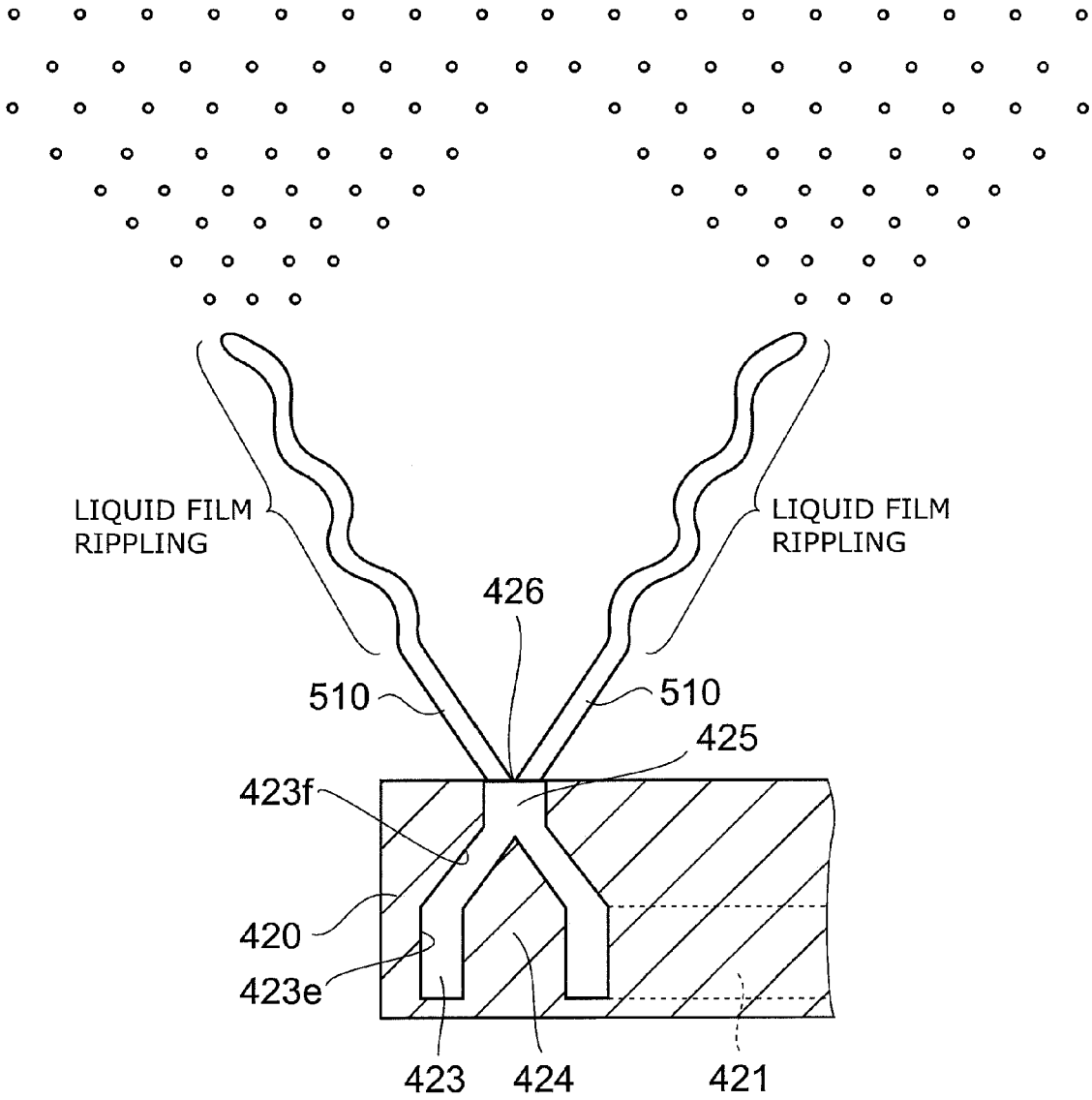
FIG. 9 is a sectional schematic view showing a nozzle according to a comparative example.

FIG. 9 is a sectional schematic view showing a nozzle according to a comparative example.

Figure 10:
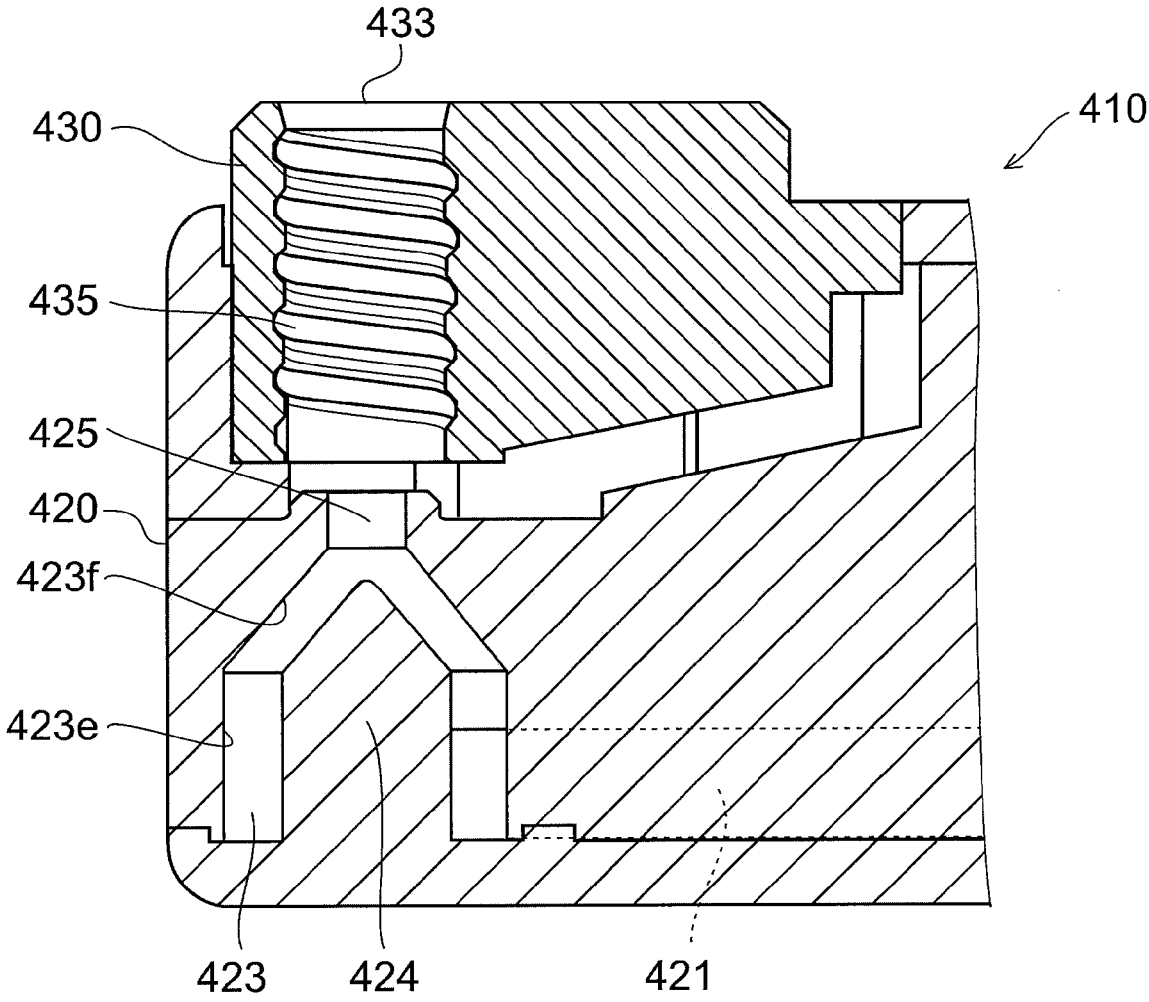
FIG. 10 is a sectional schematic view illustrating a variation of the annular flow channel.

FIG. 10 is a sectional schematic view illustrating a variation of the annular flow channel.

Here, FIG. 8 shows an example regarding the jetting mode illustrated in FIG. 5, where the liquid film flow 510 is fragmented and transitions to a granular flow 520.

As shown in FIG. 8, the nozzle 410 of this example includes a nozzle body 420 and a throat 430. The nozzle body 420 includes therein a nozzle body flow channel 421 for passing water supplied from a water source, not shown, a swirling chamber 423 capable of generating a swirling flow, and a communication channel 425 for guiding water from the swirling chamber 423 to the throat 430. At the center of the swirling chamber 423, a protrusion 424 for generating a swirling flow with stabler swirling power is provided.

The swirling chamber 423 is a hollow chamber formed from a large diameter inner peripheral wall 423*e* having a larger diameter at the bottom, and an inclined inner peripheral wall 423*f* having a diameter shrinking toward the communication channel 425. At one end of the inclined inner peripheral wall 423*f*, the inclined inner peripheral wall 423*f* is connected to the communication channel 425. On the other hand, the nozzle body flow channel 421 is connected eccentrically to the swirling chamber 423. More specifically, the nozzle body flow channel 421 is connected in the tangential direction of the large diameter inner peripheral wall 423*e* of the swirling chamber 423.

The throat 430 includes therein an annular flow channel 431 for passing water jetted from the communication channel 425 of the nozzle body 420. Furthermore, a jetting port 433 is formed at one end of the annular flow channel 431. The jetting port 433 is configured so that the water passed through the annular flow channel 431 is jetted outside the throat 430. The annular flow channel 431 near the jetting port 433 includes a taper portion 432*a* having a flow channel expanding toward the jetting port 433. On the upstream side of the taper portion 432*a*, a linear portion 432*b* having a constant flow channel diameter is formed so that the center axis of the communication channel 425 is parallel to the center axis of the linear portion 432*b*.

When water is supplied to the nozzle 410 from a water source, not shown, the water passes through the nozzle body flow channel 421 and flows into the swirling chamber 423. Here, the nozzle body flow channel 421 is connected in the tangential direction of the large diameter inner peripheral wall 423*e* of the swirling chamber 423. Hence, the water poured into the swirling chamber 423 swirls along the large diameter inner peripheral wall 423*e* and the inclined inner peripheral wall 423*f*. Then, the water swirled in the swirling chamber 423 passes through the communication channel 425 while maintaining the swirling power, and is jetted into the annular flow channel 431 of the throat 430. At this time, the water jetted from the nozzle body 420 maintains the swirling power. Hence, the water is jetted in a hollow-conic shape as a liquid film flow including a hollow portion at the center.

The water poured into the annular flow channel 431 flows along the inner wall of the annular flow channel 431 while maintaining the swirling power, and is guided to the jetting port 433. That is, the water passing through the annular flow channel 431 flows in contact with the inner wall of the annular flow channel 431. Hence, the water flowing in the annular flow channel 431 is subjected to resistance due to the frictional force from the inner wall of the annular flow channel 431. The flow velocity is slowed down toward the jetting port 433. Thus, as shown in FIG. 8, the thickness of the liquid film near the jetting port 433 is made thicker than the thickness of the liquid film just jetted from the nozzle body 420, or the thickness of the liquid film just poured into the annular flow channel 431.

Furthermore, the flow velocity of the water flowing in the annular flow channel 431 is faster in the central portion of the annular flow channel 431 than near the inner wall of the annular flow channel 431, i.e., in the boundary layer. Hence, inside the water flowing in the annular flow channel 431, as indicated by arrow A1 shown in FIG. 8, vortices are generated in a direction traversing the liquid film. Furthermore, in the annular flow channel 431 near the jetting port 433, a taper portion 432*a* having a flow channel expanding toward the jetting port 433 is formed. Hence, the water jetted from the jetting port 433 flows along the rectilinear portion 432*b* and the taper portion 432*a*. Thus, inside the water jetted from the jetting port 433, vortices are more likely to occur in a direction traversing the liquid film.

Then, the water jetted from the jetting port 433 is jetted as a liquid film flow 510 including a hollow portion at the center, i.e., in a hollow-conic shape, and transitions to a granular flow 520 at a position spaced to some extent from the jetting port 433. More specifically, inside the liquid film flow 510 jetted from the jetting port 433, vortices are generated in a direction traversing the liquid film. Hence, at a position spaced to some extent from the jetting port 433, a crack occurs between adjacent vortices. Accordingly, as shown in FIG. 8, the liquid film flow 510 jetted from the jetting port 433 is fragmented at a position spaced to some extent from the jetting port 433. Thus, the liquid film flow 510 jetted from the jetting port 433 transitions to a granular flow 520. That is, the annular flow channel 431 of the throat 430 of this example is a granular-flow generating means for generating an intermittent water flow of granular water balls so as to fill the hollow portion of the liquid film flow 510.

The pressure in the hollow portion of the liquid film flow 510 is lower than the pressure outside the liquid film flow 510. The reason for this is as follows. Air is less likely to enter the hollow portion of the liquid film flow 510 from outside. Furthermore, the air in the hollow portion is drawn out by the stream of the liquid film flow 510. Thus, the pressure in the hollow portion of the liquid film flow 510 is lower than the pressure outside the liquid film flow 510. This suppresses expansion of the jet diameter (cone diameter) of the liquid film flow 510.

Hence, the nozzle 410 of this example can suppress impingement of the granular flow 520 outside the washing area. This can suppress discomfort felt by the user seated on the toilet seat 200 due to unnecessary wetting of the portion (e.g., thigh) outside the desired washing area.

Furthermore, as described above with reference to FIG. 2, the granular flow 520 has a diameter of e.g. approximately 1 mm, larger than that of spray, which has a diameter of e.g. approximately 10-100 μm. This is because as described above, the flow velocity of water flowing in the annular flow channel 431 is slowed down toward the jetting port 433, thus thickening the thickness of the liquid film near the jetting port 433. That is, the liquid film flow 510 jetted with a thicker liquid film is forcibly granulated by vortices generated inside the annular flow channel 431. Hence, the granular water ball constituting the granular flow 520 has a larger diameter than spray.

Accordingly, there is little danger that the water ball included in the granular flow 520 drifts in air, because the water ball has a large diameter. Thus, there is little danger that the water ball scatters to the outside of the desired washing area. That is, the nozzle 410 of this example can suppress impingement of the granular flow 520 outside the washing area, and can suppress unnecessary wetting of the portion outside the desired washing area. Furthermore, because of the large diameter of the water ball constituting the granular flow 520, the impinging water pressure and impinging water amount at the impingement site can be made higher. Hence, for instance, menstrual blood dirt during women's menstruation can be removed or released more rapidly, and washed away rapidly.

As described above, the pressure in the hollow portion of the liquid film flow 510 is lower than the pressure outside the liquid film flow 510. On the other hand, the pressure in the hollow portion of the liquid film flow 510 is higher in the case where the liquid film flow 510 is fragmented than in the case where the liquid film flow 510 is not fragmented. This is because as indicated by arrow A2 shown in FIG. 8, air outside the liquid film flow 510 enters the hollow portion through a crack generated between adjacent vortices, or through a gap between the fragmented liquid film flows 510. This can suppress the washing area becoming narrower than the desired range due to excessive decrease of pressure in the hollow portion of the liquid film flow 510. Furthermore, by fragmenting the liquid film flow, the pressure in the hollow portion of the liquid film flow 510 can be increased. This can suppress the occurrence of liquid film rippling.

Here, liquid film rippling is described with reference to the comparative example shown in FIG. 9.

The nozzle of the comparative example shown in FIG. 9 does not include an annular flow channel, i.e., granular-flow generating means. Hence, the water poured into the swirling chamber 423 swirls along the large diameter inner peripheral wall 423*e* and the inclined inner peripheral wall 423*f*, passes through the communication channel 425, and is jetted as a liquid film flow 510 including a hollow portion at the center. In the nozzle of this comparative example, one end of the communication channel 425 functions as a jetting port 426.

The water passing through the communication channel 425 of this comparative example is not decelerated by resistance, because there is no annular flow channel 431 of the example shown in FIG. 8. Hence, the thickness of the liquid film of the water passing through the communication channel 425 of this comparative example is thinner than the thickness of the liquid film of the water flowing in the annular flow channel 431 of the example shown in FIG. 8. Thus, vortices are less likely to occur in a direction traversing the liquid film. That is, the liquid film flow 510 jetted from the jetting port 426 of this comparative example is less likely to be fragmented than in the example shown in FIG. 8.

The liquid film flow 510 of this comparative example continues to expand while remaining the liquid film without being fragmented. With the expansion of the jet diameter of the liquid film flow 510, the thickness of the liquid film becomes thinner. Thus, the liquid film of the liquid film flow 510 becomes more susceptible to the pressure difference between the hollow portion of the liquid film flow 510 and the portion outside the liquid film flow 510.

Hence, as shown in FIG. 9, liquid film rippling occurs at a position spaced to some extent from the jetting port 426 due to the pressure difference between the hollow portion of the liquid film flow 510 and the portion outside the liquid film flow 510.

If the liquid film of the liquid film flow 510 is fragmented after liquid film rippling occurs, the granulated water flow after fragmentation scatters in irregular directions due to the effect of rippling. Hence, the water is likely to scatter to the outside of the desired washing area. The scattered water is attached to the thigh of the user seated on the toilet seat 200, and the user may feel discomfort.

Liquid film rippling occurs at a position where the thickness of the liquid film is thinned. Furthermore, the occurrence of rippling further elongates the trajectory of the liquid film. Hence, the thickness of the liquid film becomes thinner. That is, if liquid film rippling occurs in the liquid film flow 510, the liquid film flow 510 is fragmented into spray having a smaller diameter than the granular water ball constituting the granular flow 520 shown in FIG. 8. As described above, the spray has a small diameter, and has a small mass. Hence, the spray drifts in air, and is likely to scatter to the outside of the desired washing area. The scattered water is attached to the thigh of the user seated on the toilet seat 200, and the user may feel discomfort.

In contrast, in the nozzle 410 according to this example, the thickness of the liquid film near the jetting port 433 is larger than the thickness of the liquid film just jetted from the nozzle body 420, or the thickness of the liquid film just poured into the annular flow channel 431. Hence, inside the water jetted from the jetting port 433, vortices are more likely to occur in a direction traversing the liquid film. Thus, the liquid film flow 510 is more likely to be fragmented, and air is more likely to enter the hollow portion thereof. This can prevent the pressure in the hollow portion of the liquid film flow 510 from decreasing. Thus, the occurrence of liquid film rippling in the liquid film flow 510 can be suppressed.

Accordingly, scattering of the granulated water flow in irregular directions due to the effect of rippling, and scattering of water to the outside of the desired washing area can be suppressed. Furthermore, unnecessary wetting of the portion outside the desired washing area can be suppressed. Furthermore, fragmentation of the liquid film flow 510 into spray can be suppressed.

The occurrence of liquid film rippling is prevented by thickening the liquid film. Furthermore, before liquid film rippling occurs, the liquid film flow 510 is forcibly granulated by vortices generated inside the throat 430. Hence, the diameter of the granular flow 520 can be made larger. Scattering of water to the outside of the desired washing area can be suppressed, and unnecessary wetting of the portion outside the desired washing area can be suppressed. This can suppress causing the user seated on the toilet seat 200 to feel discomfort due to unnecessary wetting of the portion outside the desired washing area.

Furthermore, because the occurrence of liquid film rippling in the liquid film flow 510 can be suppressed, excessive decrease of pressure in the hollow portion of the liquid film flow 510 can be suppressed. Hence, with the hollow portion of the liquid film flow 510 filled with a granular flow 520, water can be caused to impinge on a wider range of the human private parts of the user seated on the toilet seat 200. Thus, the desired wide range can be washed quickly at once.

In the variation shown in FIG. 10, a spiral groove 435 is formed on the inner wall of the annular flow channel. In this case, the water flowing in the annular flow channel is subjected to larger resistance from the spiral groove 435. More specifically, the swirling component of the velocity of the water flowing in the annular flow channel is maintained, but the rectilinear component of the velocity is decelerated.

Furthermore, the time of contact between the water flowing in the annular flow channel and the spiral groove 435 is longer than in the case without the spiral groove 435. Hence, in this variation, the water flowing in the annular flow channel is subjected to the frictional force from the spiral groove 435 over a longer time than in the case without the spiral groove 435.

Hence, the thickness of the liquid film of the water flowing in the annular flow channel of this variation is thicker than the thickness of the liquid film of the water flowing in the annular flow channel 431 of the example shown in FIG. 8. That is, by forming a spiral groove 435 on the inner wall of the annular flow channel, the thickness of the liquid film near the jetting port 433 can be made thicker. Hence, the liquid film flow 510 jetted from the jetting port 433 is fragmented more reliably at a position spaced to some extent from the jetting port 433.

Figure 11:
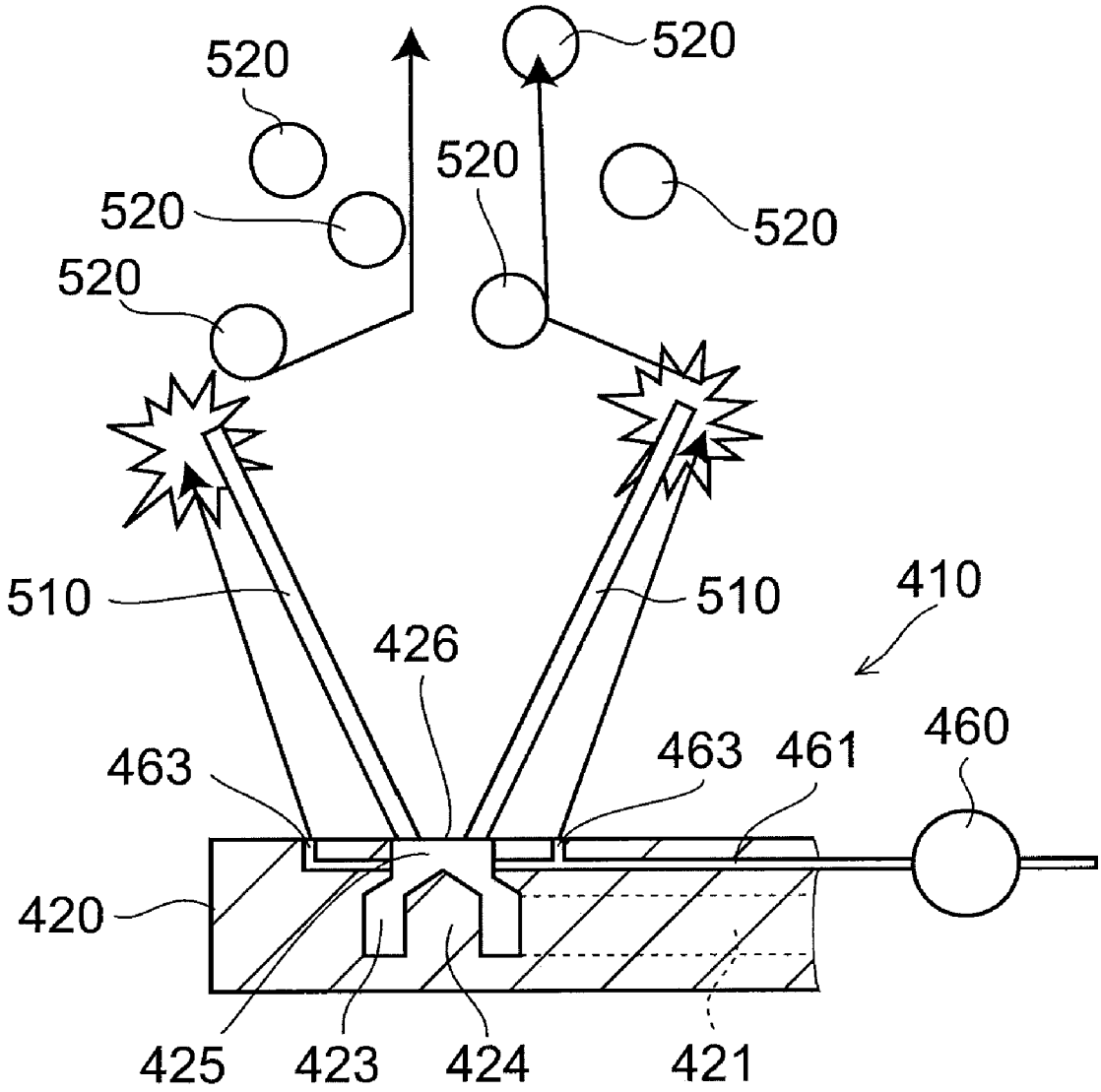
FIG. 11 is a sectional schematic view showing a nozzle according to another example of this embodiment.

FIG. 11 is a sectional schematic view showing a nozzle according to another example of this embodiment.

Here, as in the example shown in FIG. 8, FIG. 11 shows an example regarding the jetting mode illustrated in FIG. 5, where the liquid film flow 510 is fragmented and transitions to a granular flow 520.

The nozzle 410 according to this example does not include an annular flow channel, but includes a nozzle body 420. The water poured into the swirling chamber 423 swirls in the swirling chamber 423, passes through the communication channel 425, and is jetted as a liquid film including a hollow portion at the center, i.e., as a liquid film flow 510. That is, in the nozzle 410 of this example, one end of the communication channel 425 functions as a jetting port 426.

Furthermore, the sanitary washing apparatus 100 equipped with the nozzle 410 according to this example includes a fluid squirting device 460 for fragmenting the liquid film flow 510 jetted from the jetting port 426 on the upstream side of the nozzle 410. The fluid squirting device 460 is illustratively a pump capable of generating a liquid flow or an air flow. Furthermore, the nozzle body 420 includes therein a squirting flow channel 461 for passing the liquid flow or air flow supplied from the fluid squirting device 460. One end of the squirting flow channel 461 is connected to the fluid squirting device 460. The other end of the squirting flow channel 461 functions as a squirting port 463 for squirting the liquid flow or air flow supplied from the fluid squirting device 460. The remaining structure is similar to the structure of the nozzle 410 according to the example described above with reference to FIG. 8.

As shown in FIG. 11, the nozzle 410 according to this example enables the liquid flow or air flow supplied from the fluid squirting device 460 through the squirting flow channel 461 to be squirted from the squirting port 463 and to collide with the liquid film flow 510 jetted from the jetting port 426. Accordingly, the liquid film flow 510 jetted from the jetting port 426 is fragmented by the liquid flow or air flow squirted from the squirting port 463 and transitions to a granular flow 520.

That is, the fluid squirting device 460 of this example functions as a granular-flow generating means for generating a granulated water flow so as to fill the hollow portion of the liquid film flow 510.

According to this example, the liquid film flow 510 is fragmented by colliding a liquid flow or air flow with the liquid film flow 510. Hence, the position of fragmentation can be controlled more reliably. Thus, water can be caused to impinge more accurately on the desired washing range. The other effects are also achieved similarly to the effects described above with reference to FIGS. 8 to 10.

Figure 12:
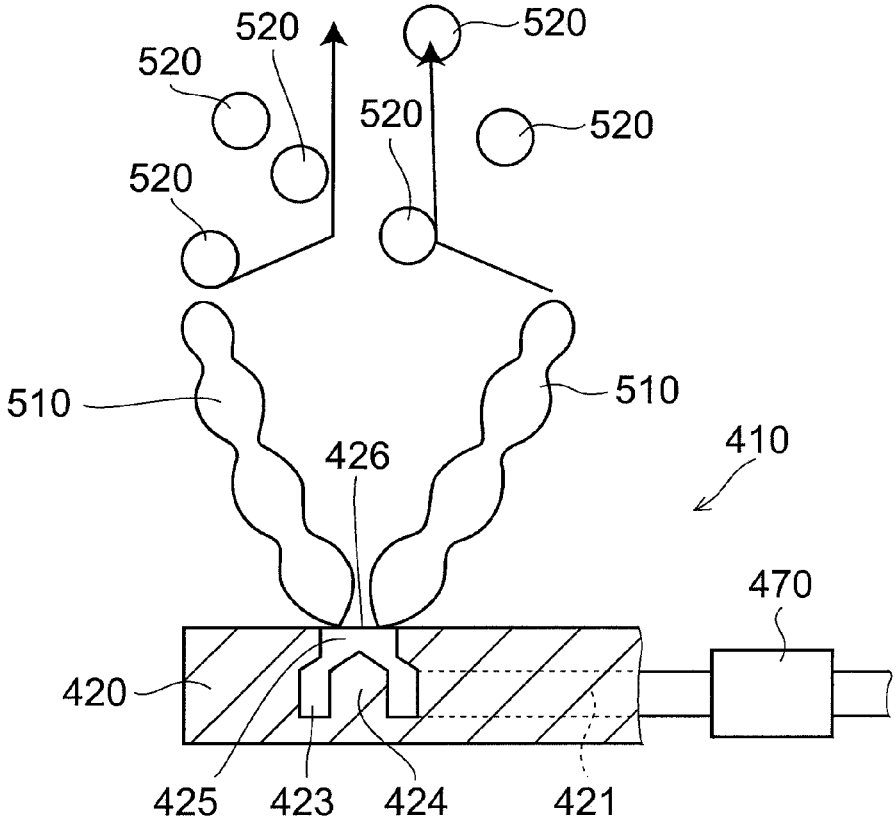
FIG. 12 is a sectional schematic view showing a nozzle according to still another example of this embodiment.

FIG. 12 is a sectional schematic view showing a nozzle according to still another example of this embodiment.

Figure 13:
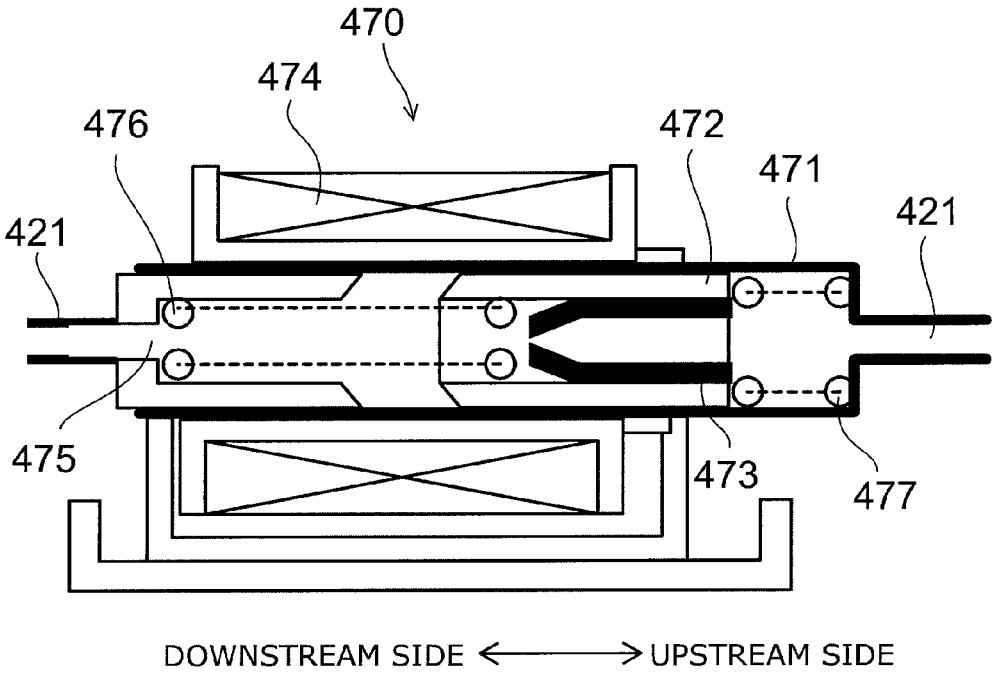
FIG. 13 is a sectional schematic view illustrating an internal structure of a water-pressure modulator of this example.

FIG. 13 is a sectional schematic view illustrating an internal structure of a water-pressure modulator of this example.

Figure 14:
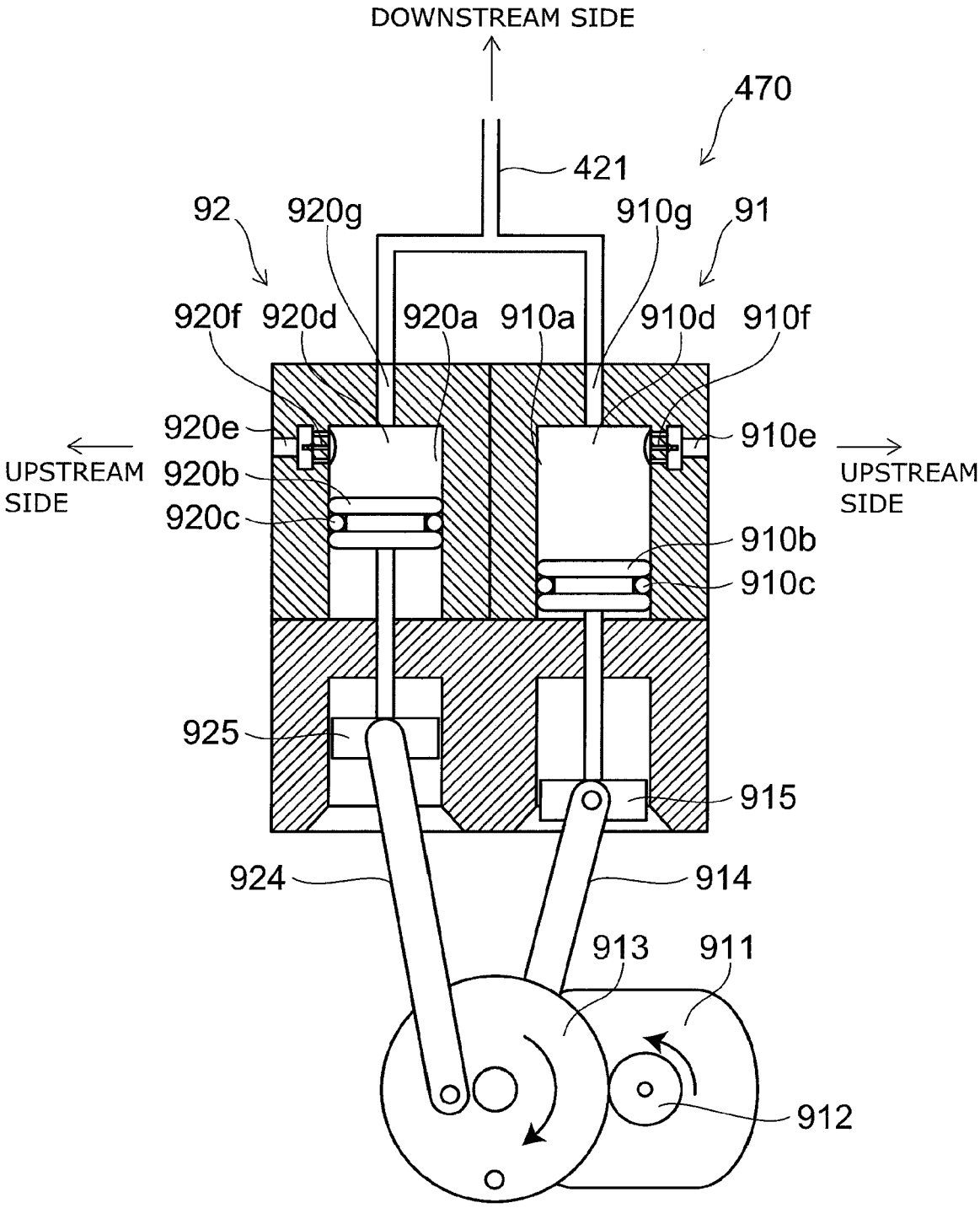
FIG. 14 is a sectional schematic view illustrating another internal structure of the water-pressure modulator of this example.

FIG. 14 is a sectional schematic view illustrating another internal structure of the water-pressure modulator of this example.

Here, as in the example shown in FIG. 8, FIG. 12 shows an example regarding the jetting mode illustrated in FIG. 5, where the liquid film flow 510 is fragmented and transitions to a granular flow 520.

Like the nozzle 410 of the example described above with reference to FIG. 11, the nozzle 410 according to this example includes a nozzle body 420. However, the nozzle 410 according to this example does not include an annular flow channel.

The water poured into the swirling chamber 423 swirls in the swirling chamber 423, passes through the communication channel 425, and is jetted as a liquid film including a hollow portion at the center, i.e., as a liquid film flow 510. In the nozzle 410 of this example, one end of the communication channel 425 functions as a jetting port 426.

Furthermore, the sanitary washing apparatus 100 equipped with the nozzle 410 according to this example includes a water-pressure modulator 470 in midstream of the nozzle body flow channel 421. This water-pressure modulator 470 provides pulsation to the flow of water in the nozzle body flow channel 421. That is, the water-pressure modulator 470 provides pulsation to the water jetted from the jetting port 426. The remaining structure is similar to the structure of the nozzle 410 according to the example described above with reference to FIG. 8.

Here, an example of the internal structure of the water-pressure modulator 470 is described with reference to the internal structure illustrated in FIG. 13.

As described above, the water-pressure modulator 470 provides pulsation to the flow of water in the nozzle body flow channel 421. Here, the term "pulsation" used herein refers to pressure variation caused by the water-pressure modulator 470. Thus, the water-pressure modulator 470 is a device for varying the pressure of water in the nozzle body flow channel 421.

As shown in FIG. 13, the water-pressure modulator 470 includes a cylinder 471 connected to the nozzle body flow channel 421, a plunger 472 reciprocably provided inside the cylinder 471, a check valve 473 provided inside the plunger 472, and a pulsation generating coil 474 for reciprocating the plunger 472 under a controlled excitation voltage.

The check valve is disposed so that the pressure of water on the downstream side of the water-pressure modulator 470 increases when the position of the plunger 472 is changed to the nozzle 410 side (downstream side), and that the pressure of water on the downstream side of the water-pressure modulator 470 decreases when the position of the plunger 472 is changed to the side opposite to the nozzle 410 (upstream side). In other words, the pressure of water on the upstream side of the water-pressure modulator 470 decreases when the position of the plunger 472 is changed to the nozzle 410 side (downstream side). The pressure of water on the upstream side of the water-pressure modulator 470 increases when the position of the plunger 472 is changed to the side opposite to the nozzle 410 (upstream side).

The plunger 472 is moved to the upstream or downstream side by controlling the excitation of the pulsation generating coil 474. That is, to add pulsation to the water in the nozzle body flow channel 421 (to vary the pressure of the water in the nozzle body flow channel 421), the plunger 472 is reciprocated in the axial direction (upstream/downstream direction) of the cylinder 471 by controlling the excitation voltage applied to the pulsation generating coil 474.

Here, by excitation of the pulsation generating coil 474, the plunger 472 moves from the original position (plunger original position) as shown to the downstream side 475. Then, when the excitation of the pulsation generating coil 474 is extinguished, the plunger 472 returns to the original position by the biasing force of a return spring 476. Here, a buffer spring 477 buffers the return motion of the plunger 472. The plunger 472 includes therein a duckbill check valve 473 to prevent backflow to the upstream side.

Hence, when the plunger 472 moves from the plunger original position to the downstream side, the plunger 472 can pressurize water in the cylinder 471 to drive the water to the nozzle body flow channel 421 on the downstream side. In other words, when the plunger 472 moves from the plunger original position to the downstream side, the plunger 472 can decompress water in the nozzle body flow channel 421 on the upstream side to suck the water into the cylinder 471. Here, because the plunger original position and the position after the motion to the downstream side are always the same, the amount of water fed to the nozzle body flow channel 421 on the downstream side in response to the motion of the plunger 472 is constant.

Subsequently, at the time of return to the original position, water flows into the cylinder 471 through the check valve 473. Thus, at the next time when the plunger 472 moves to the downstream side, a constant amount of water is newly fed to the nozzle body flow channel 421 on the downstream side. Thus, the water-pressure modulator 470 can provide pulsation to the flow of water in the nozzle body flow channel 421.

Next, another example of the internal structure of the water-pressure modulator 470 is described with reference to the internal structure illustrated in FIG. 14.

The water-pressure modulator 470 shown in FIG. 14 has a dual configuration composed of a first water-pressure modulator 91 and a second water-pressure modulator 92. The first water-pressure modulator 91 and the second water-pressure modulator 92 include cylinders 910*a*, 920*a*, respectively, each including a cylindrical space. A piston 910*b*, 920*b* is provided in the cylinder 910*a*, 920*a*. The piston 910*b*, 920*b* is equipped with an O-ring 910*c*, 920*c*. Each space defined by the piston 910*b*, 920*b* and the cylinder 910*a*, 920*a* constitutes a pressurizing chamber 910*d*, 920*d*.

The pressurizing chamber 910*d*, 920*d* is provided with a water inlet 910*e*, 920*e* branched from the nozzle body flow channel 421 so that water flows into the water inlet 910*e*, 920*e*. A conduit, not shown, branched from the nozzle body flow channel 421 is connected to the water inlet 910*e*, 920*e* so that water can be poured from the nozzle body flow channel 421 into the pressurizing chamber 910*d*, 920*d*.

Here, umbrella packings 910*f*, 920*f* are provided so as to prevent backflow. That is, the umbrella packing 910*f*, 920*f* is provided in the portion where the water inlet 910*e*, 920*e* opens to the pressurizing chamber 910*d*, 920*d* so that the water poured into the pressurizing chamber 910*d*, 920*d* does not flow back to the upstream side of the nozzle body flow channel 421.

Furthermore, water outlets 910*g*, 920*g* are provided and merged on the way to eject the pressurized water. That is, the water outlets 910*g*, 920*g* are provided in the ceiling portion of the pressurizing chambers 910*d*, 920*d*, respectively. A piping is connected to each of the water outlets 910*g*, 920*g*, and each connected piping is connected to the nozzle body flow channel 421 on the downstream side through a bifurcation. Thus, flows of water flowing out of the pressurizing chambers 910*d*, 920*d* are merged on the way and ejected to the downstream side of the nozzle body flow channel 421 as pressurized water.

A gear 912 is attached to the rotary shaft of a motor 911 and meshed with a gear 913. A crankshaft 914 for driving the piston 910*b* of the first water-pressure modulator 91 and a crankshaft 924 for driving the piston 920*b* of the second water-pressure modulator 92 are attached to different positions of the gear 913. The crankshaft 914, 924 is attached to the piston 910*b*, 920*b* through a piston holder 915, 925. Here, the positions of the crankshafts attached to the gear 913 are different in attachment radius so that the amount of stroke of the piston 910*b* is different from that of the piston 920*b*, and they are attached to positions 90° out of phase. Furthermore, the stroke of the piston 920*b* of the second water-pressure modulator 92 is adjusted so as to be shorter than the stroke of the piston 910*b* of the first water-pressure modulator 91 and driven 90° out of phase. Thus, because the operation of the pistons 910*b*, 920*b* is adjusted in advance by the attachment positions of the crankshafts 914, 914 on the gear 913, it is possible to cause the water-pressure modulator 470 to perform a predetermined operation by a simple control of only turning on/off the energization switch of the motor.

When the motor 911 is energized, the rotary shaft rotates. Thus, the pistons 910*b*, 920*b* are vertically reciprocated through the gears 912, 913, the crankshafts 914, 924, and the piston holders 915, 925. When the pressurizing chamber is filled with water, if the piston 910*b* (920*b*) moves from the lower dead center (original position) to the upper dead center, the volume of the pressurizing chamber decreases. Hence, the water is pressurized and driven toward the downstream side of the nozzle body flow channel 421.

Subsequently, in return from the upper dead center to the lower dead center (original position), the pressure in the pressurizing chamber decreases, and the umbrella packing 910*f*, 920*f* opens to allow water to flow into the pressurizing chamber. Subsequently, at the next time of piston movement, the water is pressurized again. This process is successively performed to generate pressure variation, or pulsation. Thus, the water-pressure modulator 470 shown in FIG. 14 can provide pulsation to the flow of water in the nozzle body flow channel 421.

According to this example, the water-pressure modulator 470 can provide pulsation to the water jetted from the jetting port 426. Hence, in the liquid film flow 510 jetted from the jetting port 426, the pulsation generates cracks in a direction traversing the liquid film. Thus, the liquid film flow 510 transitions to a granular flow 520 including water balls with a larger diameter. The water-pressure modulator 470 of this example functions as a granular-flow generating means for generating a granulated water flow so as to fill the hollow portion of the liquid film flow 510.

The liquid film flow 510 jetted from the jetting port 426 is fragmented in a direction traversing the liquid film flow by the pulsation provided by the water-pressure modulator 470. This can increase the diameter of the granular water ball constituting the granular flow 520. Hence, the impinging water pressure and impinging water amount at the impingement site can be made higher. Thus, for instance, menstrual blood dirt during women's menstruation can be removed or released more rapidly, and washed away more rapidly. The other effects are also achieved similarly to the effects described above with reference to FIGS. 8 to 10.

Figure 15:
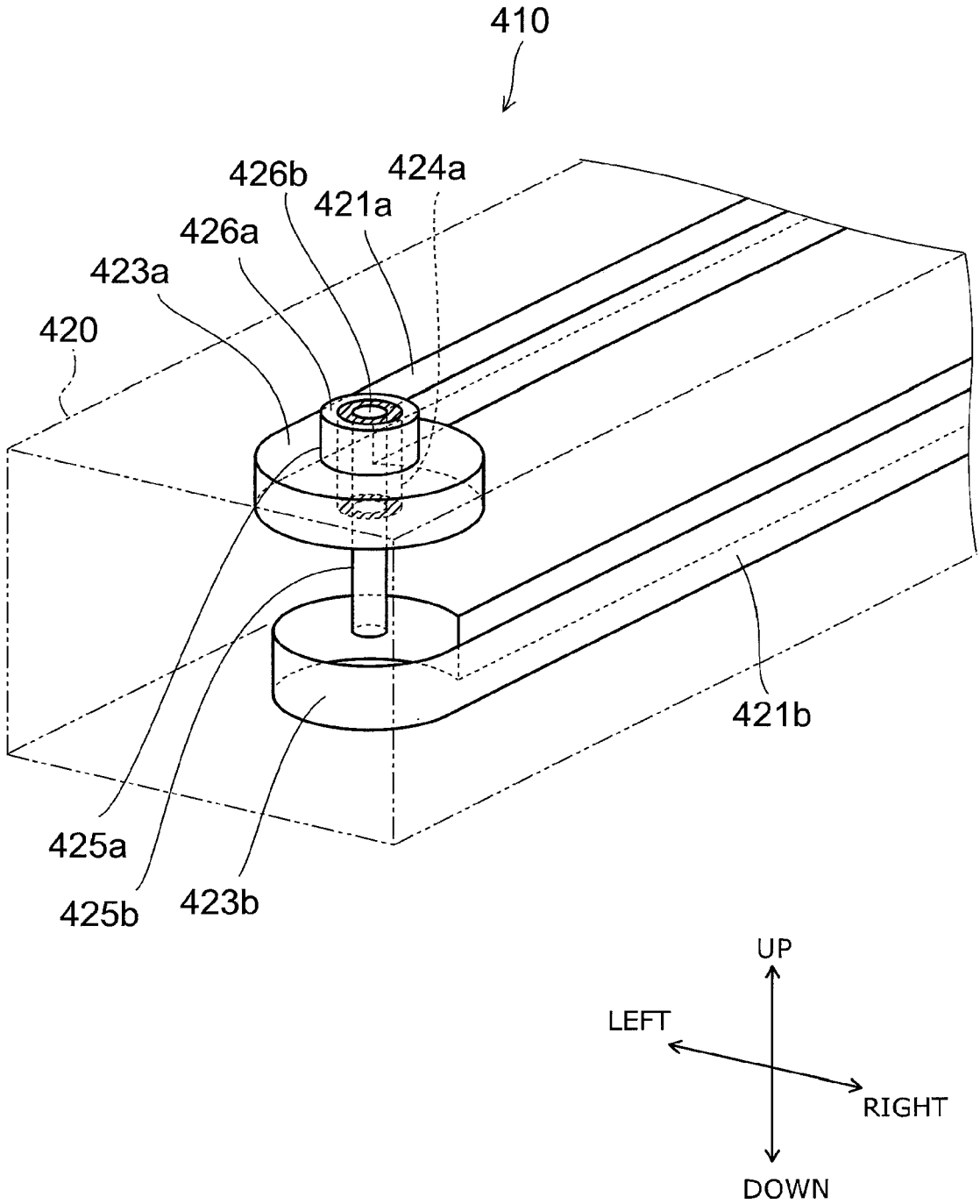
FIG. 15 is a perspective schematic view showing a nozzle according to still another example of this embodiment.

FIG. 15 is a perspective schematic view showing a nozzle according to still another example of this embodiment.

Figure 16:
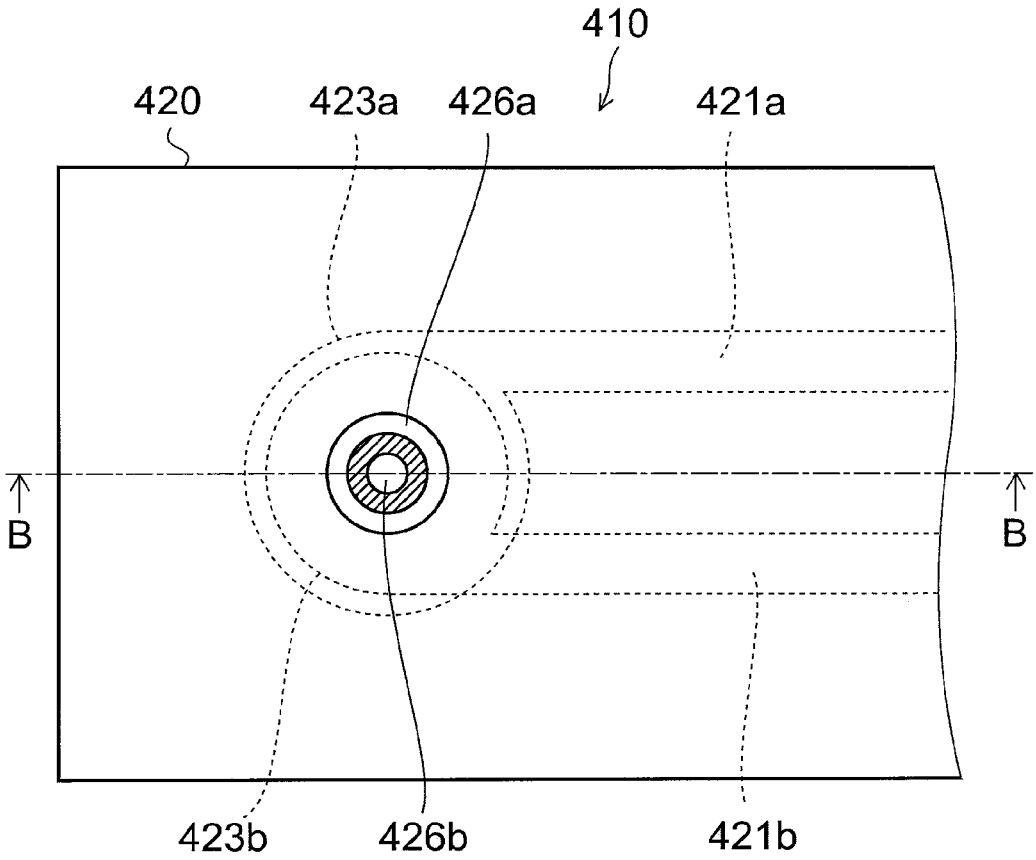
FIG. 16 is a top schematic view of the nozzle according to this variation as viewed from above.

FIG. 16 is a top schematic view of the nozzle according to this variation as viewed from above.

Figure 17:
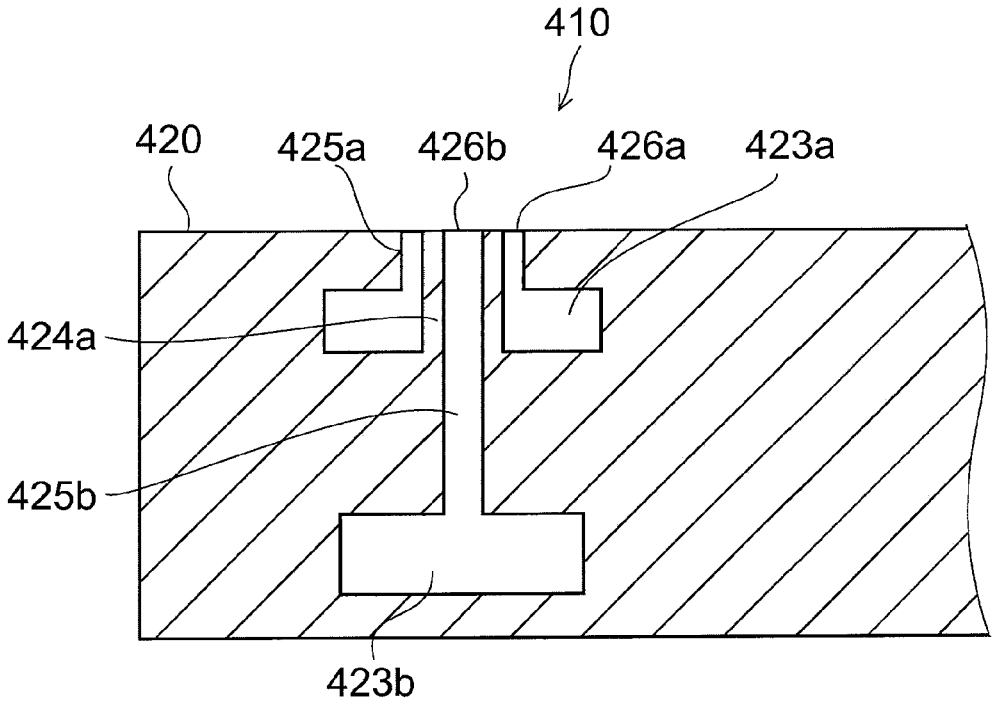
FIG. 17 is a schematic end view in the cutting plane B-B shown in FIG. 16.

FIG. 17 is a schematic end view in the cutting plane B-B shown in FIG. 16.

In the perspective schematic view shown in FIG. 15, for convenience of description, the internal structure is also depicted by solid lines as appropriate.

Here, FIGS. 15 to 17 show examples regarding the jetting modes illustrated in FIGS. 6 and 7. In one example, the water jetted to the hollow portion of the liquid film flow 510 is fragmented and transitions to a granular flow 520. In the other example, a granular flow 520 is jetted in the hollow portion of the liquid film flow 510.

As shown in FIG. 15, the nozzle 410 of this example includes a nozzle body 420. The nozzle body 420 includes therein a first nozzle body flow channel 421*a* and a second nozzle body flow channel 421*b* for passing water supplied from a water source, not shown, and a first swirling chamber 423*a* and a second swirling chamber 423*b* capable of generating a swirling flow. As shown in FIG. 16, the first nozzle body flow channel 421*a* and the second nozzle body flow channel 421*b* are connected in the tangential direction to the first swirling chamber 423*a* and the second swirling chamber 423*b*, respectively. The first nozzle body flow channel 421*a* and the first swirling chamber 423*a* are provided above the second nozzle body flow channel 421*b* and the second swirling chamber 423*b*.

At the center of the first swirling chamber 423*a*, a protrusion 424*a* for generating a swirling flow with stabler swirling power is provided. Above the first swirling chamber 423*a*, a first communication channel 425*a* connected to the first swirling chamber 423*a* is provided. One end of the first communication channel 425*a* functions as a first jetting port 426*a* for allowing the water passed through the first communication channel 425*a* to be jetted to the outside of the nozzle body 420. On the other hand, above the second swirling chamber 423*b*, a second communication channel 425*b* is provided. As shown in FIG. 17, one end of the second communication channel 425*b* is connected to the second swirling chamber 423*b*. The other end of the second communication channel 425*b* functions as a second jetting port 426*b* penetrating through the protrusion 424*a*.

The first nozzle body flow channel 421*a* is connected in the tangential direction to the first swirling chamber 423*a*. Hence, the water poured into the first swirling chamber 423*a* through the first nozzle body flow channel 421*a* swirls in the first swirling chamber 423*a*. Then, the water swirled in the first swirling chamber 423*a* passes through the first communication channel 425*a* while maintaining the swirling power, and is jetted from the first jetting port 426*a*. At this time, the water jetted from the first jetting port 426*a* maintains the swirling power. Hence, the water is jetted as a hollow-conic-shape liquid film flow 510 including a hollow portion at the center.

On the other hand, the second nozzle body flow channel 421*b* is connected in the tangential direction to the second swirling chamber 423*b*. Hence, the water poured into the second swirling chamber 423*b* through the second nozzle body flow channel 421*b* swirls in the second swirling chamber 423*b*. Then, the water swirled in the second swirling chamber 423*b* passes through the second communication channel 425*b* while maintaining the swirling power, and is jetted from the second jetting port 426*b*.

Here, as shown in FIGS. 15 and 17, the length of the second communication channel 425*b* is longer than the length of the first communication channel 425*a*. Hence, the resistance experienced by the water passing through the second communication channel 425*b* is larger than the resistance experienced by the water passing through the first communication channel 425*a*. Thus, the swirling power of the water jetted from the second jetting port 426*b* is weaker than the swirling power of the liquid film flow 510 jetted from the first jetting port 426*a*.

The water jetted from the second jetting port 426*b* is jetted as a liquid film flow 510. The jet diameter thereof is smaller than the jet diameter of the liquid film flow 510 jetted from the first jetting port 426*a*. Alternatively, the water jetted from the second jetting port 426*b* is jetted as jetting water having sufficiently reduced swirling power, i.e., as a rectilinear flow as described above with reference to FIG. 6. Thus, in either case, the water jetted from the second jetting port 426*b* is jetted to the hollow portion of the liquid film flow 510 jetted from the first jetting port 426*a*.

Then, the swirling power of the water jetted from the second jetting port 426*b* is weaker than the swirling power of the liquid film flow 510 jetted from the first jetting port 426*a*. Hence, as described above with reference to FIG. 6, the water jetted from the second jetting port 426*b* is fragmented before impinging on the human private parts, and transitions to a granular flow 520. In other words, the water jetted from the second jetting port 426*b* is fragmented and transitions to a granular flow 520. The hollow portion of the liquid film flow 510 jetted from the first jetting port 426*a* is filled with the granular flow 520. Then, the liquid film flow 510 impinges on the human private parts.

Alternatively, as described above with reference to FIG. 7, the water jetted from the second jetting port 426*b* is jetted as a granular flow 520. The granular flow 520 jetted from the second jetting port 426*b* is jetted to the hollow portion of the liquid film flow 510 jetted from the first jetting port 426*a*. In other words, the hollow portion of the liquid film flow 510 jetted from the first jetting port 426*a* is filled with the intermittent granular flow 520 jetted from the second jetting port 426*b*, and impinges on the human private parts.

The second nozzle body flow channel 421*b*, the second swirling chamber 423*b*, and the second communication channel 425*b* of this example function as a granular-flow generating means for generating an intermittent water flow granulated so as to fill the hollow portion of the liquid film flow 510.

According to this example, besides the jetting water for defining the washing area, i.e., besides the liquid film flow 510 jetted from the first jetting port 426*a*, jetting is performed to fill the hollow portion of the liquid film flow 510 to form a granular flow 520. Hence, the impinging water pressure and impinging water amount in the washing area can be more easily controlled to be uniform. Furthermore, there is no need to provide a throat 430 shown in e.g. FIG. 8. Hence, the structure of the nozzle 410 can be simplified. The other effects are also achieved similarly to the effects described above with reference to FIGS. 8 to 10.

The embodiments of the invention have been described above. However, the invention is not limited to the above description. Those skilled in the art can suitably modify the above embodiments, and such modifications are also encompassed within the scope of the invention as long as they include the features of the invention. For instance, the shape, dimension, material, and layout of various components in the nozzle 410, the nozzle body 420, the throat 430, and the annular flow channel 431, and the installation configuration of the throat 430 are not limited to those illustrated, but can be suitably modified.

Furthermore, various components in the above embodiments can be combined with each other as long as technically feasible. Such combinations are also encompassed within the scope of the invention as long as they include the features of the invention.

The invention claimed is:

1. A sanitary washing apparatus having a bidet washing function for jetting water at private parts of a female user, the apparatus comprising:

a nozzle including a jetting port configured to jet water;

means for jetting water as a hollow-conic-shape liquid film flow at the private parts of the female user from the jetting port; and means for generating an intermittent granular flow of granular water balls so as to fill inside the liquid film before the liquid film flow impinges on the private parts.

2. The sanitary washing apparatus according to claim 1, wherein the means for jetting water includes:

a swirling chamber capable of generating a swirling flow; and a communication channel configured to guide the swirling flow to the jetting port, the means for jetting water is configured so that the hollow-conic-shape liquid film flow is formed from the swirling flow and jetted from the jetting port.

3. The sanitary washing apparatus according to claim 1, wherein the means for generating an intermittent granular flow of granular water balls is configured to generate the intermittent granular flow of the granular water balls by fragmenting the liquid film flow.

4. The sanitary washing apparatus according to claim 3, wherein the means for generating an intermittent granular flow of granular water balls is configured to fragment the liquid film flow by generating a water flow in a direction traversing the liquid film flow to cause a crack in the traversing direction of the liquid film flow.

5. The sanitary washing apparatus according to claim 4, wherein the means for generating an intermittent granular flow of granular water balls is configured to cause a crack in the traversing direction of the liquid film flow by producing a velocity difference between velocity outside the liquid film flow and velocity inside the liquid film flow.

6. The sanitary washing apparatus according to claim 5, wherein the means for generating an intermittent granular flow of granular water balls is configured to produce the velocity difference between the velocity outside the liquid film flow and the velocity inside the liquid film flow by making the velocity outside the liquid film flow slower than the velocity inside the liquid film flow.

7. The sanitary washing apparatus according to claim 3, wherein the means for jetting water includes a squirting port configured to jet the water on upstream side of the jetting port of the nozzle so that the liquid film flow is jetted from the jetting port by jetting the hollow-conic-shape liquid film flow from the squirting port toward the jetting port of the nozzle, and the means for generating an intermittent granular flow of granular water balls includes an annular flow channel provided on downstream side of the means for jetting water and having a larger diameter than the squirting port, and is configured so that a downstream end portion of the annular flow channel constitutes the jetting port of the nozzle.

8. The sanitary washing apparatus according to claim 7, wherein the annular flow channel is configured to have a throat shape including an expanding taper portion having a flow channel diameter expanding toward downstream side, and an linear portion provided on upstream side of the expanding taper portion and having a constant flow channel diameter.

9. The sanitary washing apparatus according to claim 7, wherein the means for jetting water includes a swirling chamber capable of generating a swirling flow and a communication channel configured to guide the swirling flow to the squirting port, and is configured so that the hollow-conic-shape liquid film flow is formed from the swirling flow and jetted from the squirting port, and the means for generating an intermittent granular flow of granular water balls includes a spiral groove on an inner wall surface of the annular flow channel.

10. The sanitary washing apparatus according to claim 3, wherein the means for generating an intermittent granular flow of granular water balls is configured to fragment the liquid film flow by pulsating the liquid film flow.

11. The sanitary washing apparatus according to claim 10, wherein the means for generating an intermittent granular flow of granular water balls includes a water-pressure modulator configured to pulsate the liquid film flow.

12. The sanitary washing apparatus according to claim 3, wherein the means for generating an intermittent granular flow of granular water balls is configured to squirt fluid at the liquid film flow so as to fragment the liquid film flow.

13. The sanitary washing apparatus according to claim 1, wherein the means for generating an intermittent granular flow of granular water balls is configured to jet second jetting water to generate the granular flow, the second jetting water being different from first jetting water for forming the liquid film flow from the means for jetting water.

14. The sanitary washing apparatus according to claim 1, wherein the nozzle is configured so that an outer peripheral portion formed from the hollow-conic-shape liquid film flow by the means for jetting water and the granular flow filling inside of the hollow-conic shape by the means for generating an intermittent granular flow of granular water balls impinge on the private parts, and that when the water impinges on the private parts, impinging water pressure of the water per unit area is higher in the outer peripheral portion than in the inside.

15. The sanitary washing apparatus according to claim 1, wherein the nozzle is configured so that an outer peripheral portion formed from the hollow-conic-shape liquid film flow by the means for jetting water and the granular flow filling inside of the hollow-conic shape by the means for generating an intermittent granular flow of granular water balls impinge on the private parts, and that when the water impinges on the private parts, impinging amount of the water per unit area is larger in the outer peripheral portion than in the inside.

* * * * *